US008157407B2

(12) United States Patent
Palmer et al.

(10) Patent No.: US 8,157,407 B2
(45) Date of Patent: Apr. 17, 2012

(54) LONG-RANGE, HANDHELD SEARCHLIGHT

(75) Inventors: Gary Palmer, Carlsbad, CA (US); Jeffrey Kennedy, San Juan Capistrano, CA (US)

(73) Assignee: Xenonics Holdings, Inc., Carlsbad, CA (US)

( * ) Notice: Subject to any disclaimer, the term of this patent is extended or adjusted under 35 U.S.C. 154(b) by 286 days.

(21) Appl. No.: 12/187,952

(22) Filed: Aug. 7, 2008

(65) Prior Publication Data

US 2010/0033961 A1 Feb. 11, 2010

(51) Int. Cl.
*F21L 4/00* (2006.01)

(52) U.S. Cl. ..... 362/197; 362/202

(58) Field of Classification Search ..... 362/197, 362/202–206, 261–263
See application file for complete search history.

(56) References Cited

U.S. PATENT DOCUMENTS

| | | | | |
|---|---|---|---|---|
| 4,782,432 | A * | 11/1988 | Coffman | 362/184 |
| 4,888,670 | A * | 12/1989 | Sharrah | 362/205 |
| 5,036,444 | A | 7/1991 | Hiles | |
| 5,050,053 | A | 9/1991 | McDermott | |
| 5,581,356 | A | 12/1996 | Vezard | |
| 5,909,315 | A | 6/1999 | Keehn | |
| D425,643 | S | 5/2000 | Jigamian et al. | |
| 6,174,071 | B1 | 1/2001 | Chan | |
| RE37,136 | E | 4/2001 | Vezard | |
| 6,262,855 | B1 | 7/2001 | Greisz | |
| D480,048 | S | 9/2003 | Jigamian | |
| 6,702,452 | B2 | 3/2004 | Jigamian et al. | |
| D490,924 | S | 6/2004 | Jigamian | |
| 6,814,464 | B2 * | 11/2004 | Galli | 362/184 |
| 6,896,392 | B2 | 5/2005 | Jigamian et al. | |
| 6,909,250 | B2 | 6/2005 | Jigamian et al. | |
| 7,048,408 | B2 | 5/2006 | Dallas et al. | |
| 7,172,312 | B2 * | 2/2007 | Chen | 362/202 |
| D554,786 | S | 11/2007 | Rugendyke et al. | |
| D555,267 | S | 11/2007 | Lin | |
| RE40,015 | E | 1/2008 | Belliveau | |
| D558,907 | S | 1/2008 | Liu | |
| D565,220 | S | 3/2008 | Galli | |
| 7,344,268 | B2 | 3/2008 | Jigamian | |
| D565,769 | S | 4/2008 | Shiu | |
| D569,538 | S | 5/2008 | Leung | |
| D577,451 | S | 9/2008 | Shiu | |
| D577,843 | S | 9/2008 | Couture et al. | |

* cited by examiner

*Primary Examiner* — Jason Moon Han
(74) *Attorney, Agent, or Firm* — Howard IP Law Group

(57) ABSTRACT

A handheld searchlight for producing a high intensity beam of light output has an elongated housing including a handle portion for gripping by a user. A head has a window opening for transmitting a light beam. There is a mechanical coupling between the housing and the head. A parabolic reflector is mounted in the head facing the window and has an aperture for accommodating a high intensity lamp. The reflector has a longitudinal optical axis. The rotation of the head about the coupling causes movement of the parabolic reflector relative to the lamp along the optical axis thereby changing a spread of the high-intensity light beam. The searchlight further includes a rotatable bezel ring mounted on the head and a filter ring mount connected to the rotatable bezel. An optical filter is mounted in the filter ring mount.

22 Claims, 32 Drawing Sheets

LONG-RANGE, HANDHELD SEARCHLIGHT

FIELD OF THE INVENTION

The invention relates generally to illumination systems and more particularly to a high intensity, long-range handheld searchlight.

BACKGROUND OF THE INVENTION

Many nighttime operations, such as those performed by military and law enforcement, depend on the latest advancements in illumination technology to attain the best possible advantage. Handheld lighting devices with focused beams or spotlights or searchlights, whether battery-powered or line-powered, are commonly used by military, law enforcement, fire and rescue personnel, security personnel, hunters and recreational boaters among others for nighttime surveillance in any application where a high intensity spotlight is required. The conditions of use are highly varied, but generally require the light to deliver a desired field of view at long distances, be reliable, durable and field maintainable in order for it to be practically used in the designed applications. Typically the light is hand carried and must be completely operable using simple and easily access manual controls which do not require the use of two hands. Alternatives are desired where no "black holes" are produced.

SUMMARY OF THE INVENTION

According to an aspect of the present invention, a handheld searchlight for producing a high intensity beam of light output has an elongated housing including a handle portion for gripping by a user. A head having a window opening for transmitting a light beam is mechanically coupled to the housing. A parabolic reflector is mounted in the head facing the window opening and has an aperture for accommodating a high-intensity lamp. The reflector has a longitudinal optical axis. Rotation of the head about the housing about the mechanical coupling causes movement of the parabolic reflector relative to the lamp along the optical axis, thereby changing a spread of the high intensity light beam. A rotatable bezel ring is mounted on the head. A filter ring mount is connected to the rotatable bezel ring. An optical filter is mounted in the filter ring.

According to an aspect of the invention, a handheld searchlight includes an elongated housing. The searchlight includes a printed circuit board and a battery, both housed in the housing. The battery is in electrical communication with the printed circuit board. The searchlight further includes a lamp in electrical communication with the printed circuit board. A head assembly is rotatably and removably coupled to the housing. The head assembly includes a head having a window for transmitting a light beam and is rotatably coupled to the housing. A parabolic reflector is mounted in the head and has an aperture adapted to accommodate a high-intensity lamp. The reflector has a longitudinal optical axis. The rotation of the head about the housing causes movement of the parabolic reflector relative to the lamp along the optical axis, thereby changing a spread of the high-intensity light beam. A rotatable bezel ring is mounted on the head. A filter ring mount is hingeably mounted on the rotatable bezel ring and an optical filter is mounted in the filter ring mount.

In an embodiment of the invention, an end cap assembly is coupled to the housing. The end cap assembly includes an end cap and an electrical connector having a first end and a second end is mounted in the end cap. The first end of the electrical connector is adapted to be in electrical communication with an external power source and the second end is adapted to be in electrical communication with at least one of the printed circuit board and the battery.

BRIEF DESCRIPTION OF THE DRAWINGS

Understanding of the present invention will be facilitated by consideration of the following detailed description of the exemplary embodiments of the present invention taken in conjunction with the accompanying drawings, in which like numerals refer to like parts and in which:

FIG. 11C illustrates the handheld searchlight of FIG. 10B with the top and the bottom cover of the battery pack removed;

DETAILED DESCRIPTION OF PREFERRED EMBODIMENTS

The invention and its various embodiments can now be better understood by turning to the following detailed description of the exemplary embodiments which are presented as illustrated examples of the invention defined in the claims. It is expressly understood that the invention as defined by the claims may be broader than the illustrated embodiments described below. It is to be understood that the figures and descriptions of the present invention have been simplified to illustrate elements that are relevant for a clear understanding of the present invention, while eliminating, for purposes of clarity, many other elements found in typical handheld searchlights. However, because such elements are well known in the art, and because they do not facilitate a better understanding of the present invention, a discussion of such elements is not provided herein. The disclosure herein is directed to all such variations and modifications known to those skilled in the art.

Figure 1A:
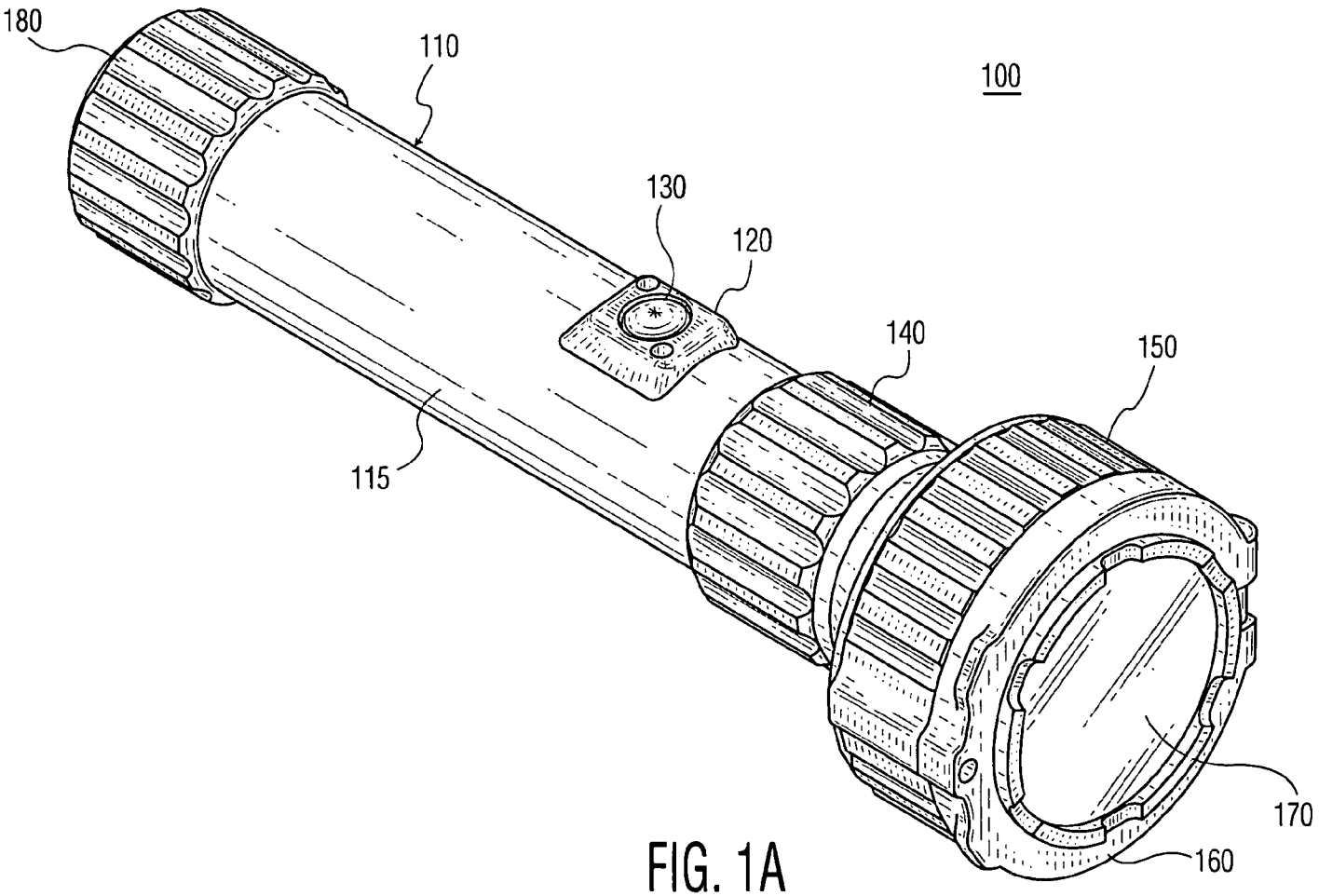
FIG. 1A is an isometric view of a handheld searchlight consistent with one embodiment of the present invention.
Figure 1B:
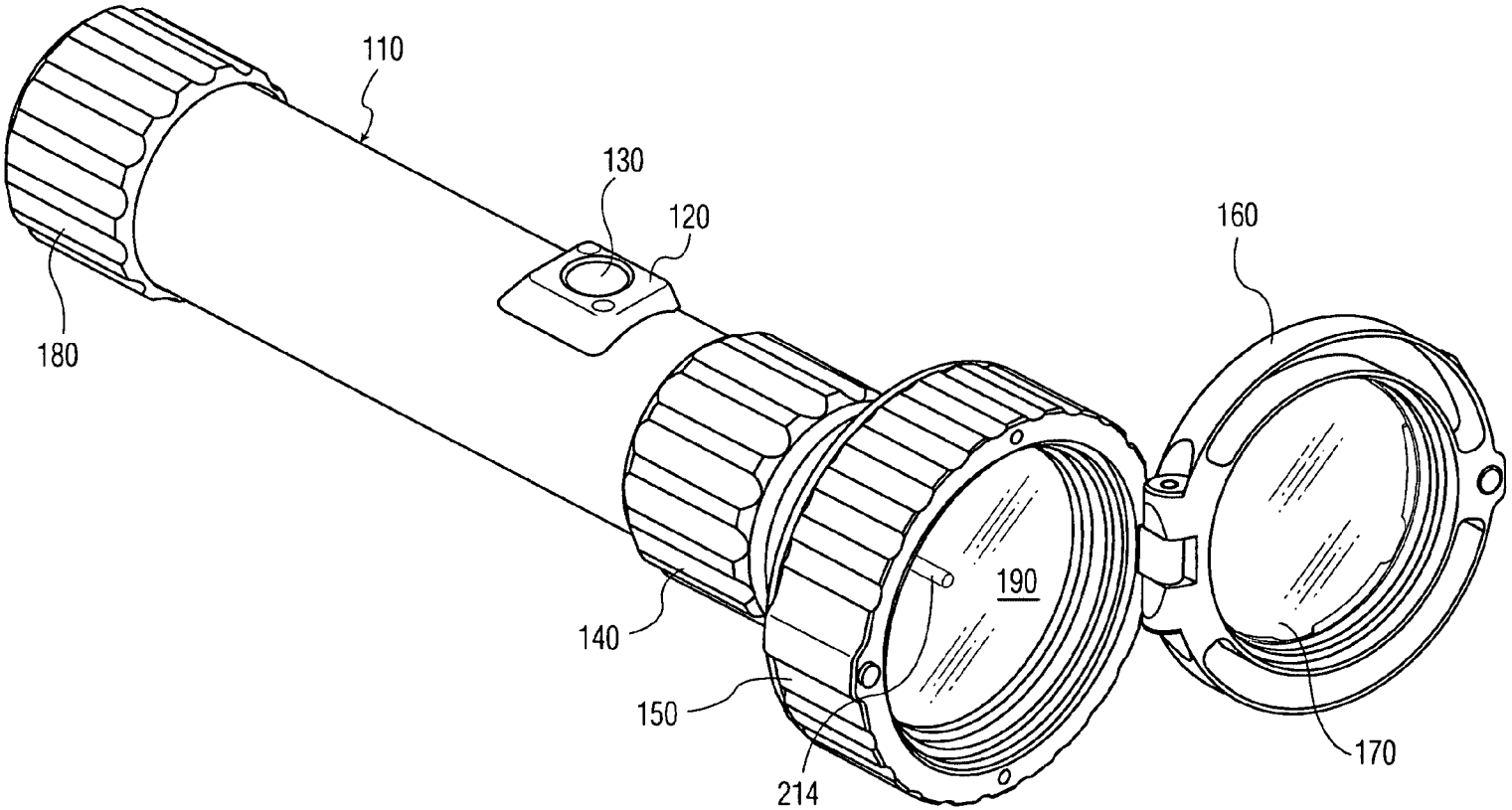
FIG. 1B is an isometric view of the handheld searchlight of FIG. 1A with the optical filter in an uncovering position.

Referring initially to FIGS. 1A and 1B, the external housing configuration for a handheld searchlight 100 is shown. The components include an elongated housing 110, a head 140, a rotatable bezel 150, a lens protector/optical filter 170 mounted in a filter ring mount 160, and an end cap assembly 180. Housing 110 has a handle portion 115 for gripping by a user. Additionally, a switch 130 is provided in handle portion 130. Switch 130 has an ON/OFF position that controls the operation of handheld searchlight 100. Switch 130 is mounted in a switch housing 120. A further external feature is the knurl design of housing 110 that provides a secure grip for the end user.

Optical filter 170 may be an infrared (IR) filter, for example, that only transmits light having wavelengths of 850 nanometer (nm) and longer. Other wavelength cut-offs of light may also be used for applications having different requirements. For example, long pass filter glass IR filter transmits light having wavelengths of about 700 nm and longer and absorbs light of shorter wavelengths. Band pass filter glass IR optical filter 170, on other hand, transmits a broad band of energy in a selected band while blocking the shorter and longer wavelengths. IR optical filter 170 serves to boost the range of night vision illumination and may also be useful in low light video equipment applications. A user using an IR filter may be able to avoid detection by preventing emission of visible light from handheld searchlight 100 while simultaneously maintaining ability to conduct surveillance in the dark using an infrared sensitive viewing device.

Optical filter 170 may alternatively be an ultraviolet filter to fluoresce objects for marking that can be achieved with the beam spread in low angle "spot" mode. Yet still, optical filter 170 may alternatively be a simple piece of glass or transparent plastic material for added protection of the lens or window 190. Other exemplary material for optical filter 170 may include filter glass, other optical-quality IR-transmitting substrates such as germanium, sapphire, silicon, zinc sulfide, and zinc selenide with or without various coatings known in the art. It is contemplated that a wide variety of filters for many applications could be employed by the present invention. FIG. 1B illustrates handheld searchlight 100 with filter ring mount 160 in an open position to show interior components of handheld searchlight 100, such as a lamp 214 and a window 190.

Figure 2:
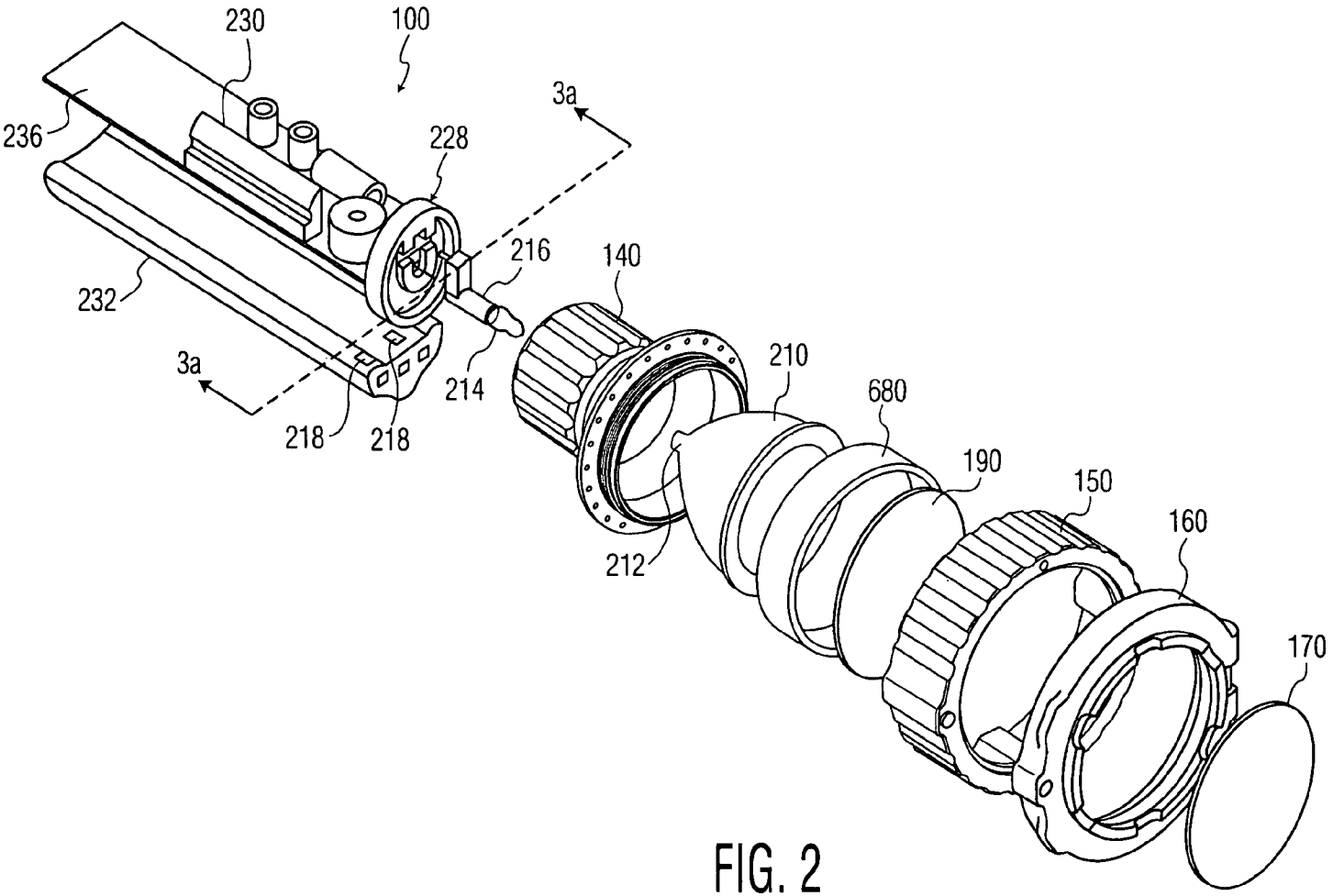
FIG. 2 is an exploded isometric view of a handheld searchlight consistent with one embodiment of the present invention with the housing and end cap sections removed illustrating its internal components.

Referring to FIG. 2, an exemplary handheld searchlight 100 showing the internal components is illustrated. Housing 110 and end cap assembly 180 are not illustrated in FIG. 2. Lens or window 190 is normally secured to head 140 (of FIG. 1A) with threaded bezel ring 150. Lamp 214 is properly aligned within the reflector's 210 optical axis of symmetry, as secured by lamp socket assembly 228. A bulkhead 240 provides support for receiving lamp 214. Head 140, reflector 210, bezel ring 680, rotatable bezel ring 150, filter ring mount 160 are described in further details below.

In the illustrated embodiment, lamp 214 is a xenon arc lamp; however, the invention is expressly intended to include other kinds of incandescent or plasma lamps, including without limitation mercury-xenon, metal halide and halogen lamps. The plasma region within lamp 214 includes a small, well-defined plasma ball where excited ions release energy in the form of photons. Lamp 214 with pin electrodes 330, 340 (of FIG. 3*d*) is secured into lamp socket assembly 228 (FIG. 3*d*). Lamp 214, thus, has a single-ended design wherein both cathode 330 (of FIG. 3*d*) and anode 340 (of FIG. 3*d*) are secured on the same end of lamp 214. The single-ended design allows for easier removal and replacement of lamps than if a lamp is secured on both ends. Ease of lamp 214 removal is advantageous because it is envisioned that this may occur in the field and at night. The glass bulb surrounding the plasma region is also named the glass envelope. The glass envelope should remain free of contamination from oil or dirt that may come from a user's fingers, especially due to the high operating temperatures attained by lamp 214. As an alternative feature, lamp 214 may be encircled by a lamp protector (not shown). Also as an alternative feature, lamp 214 may be removed and replaced using a lamp extraction tool (not shown) that is able to clamp onto lamp 214, also to prevent contamination of the glass envelope.

Still referring to FIG. 2, lamp socket assembly 228 is electrically connected to a printed circuit board (PCB) 236. PCB 236 contains circuitry for powering and controlling illumination produced by lamp 214. Additionally, power converter circuits are contained on PCB 236 to provide proper DC voltages for start up and sustained use. Also, the converter circuitry can provide the capability to power handheld searchlight 100 from an external power AC source. Battery 232 is provided to power handheld searchlight 100 for normal operation. Handheld searchlight 100 circuitry can also recharge battery 232 from an external AC power source. Additionally, heat sink 230 is mounted on PCB 236 to dissipate heat generated by the circuits. Heat sink 230 is effectively coupled to housing 110 (of FIG. 1A) to further increase thermal conductivity and improve heat transfer. Heat sink 230 is further designed so that external penetrations to housing 110 (of FIG. 1A) are not needed to provide sufficient contact for heat transfer. Heat sink 230 and housing 110 may both be made from extruded aluminum material for optimum heat transfer characteristics. Battery 232 may include sliding contacts 218 to electrically connect to PCB 236. Sliding contacts 218 provide an inherent self-cleaning capability because contacts 218 slide relative to their connections.

Figure 3A:
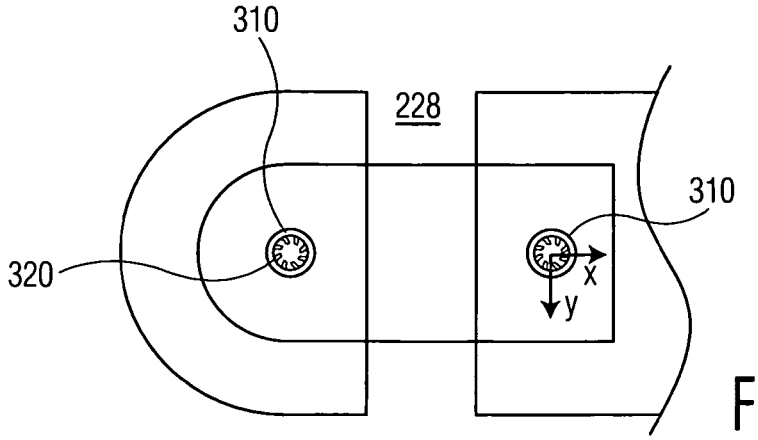
FIG. 3*a* is a sectional view taken along line 3-3 of FIG. 2, illustrating a lamp assembly system of the present invention.
Figure 3B:
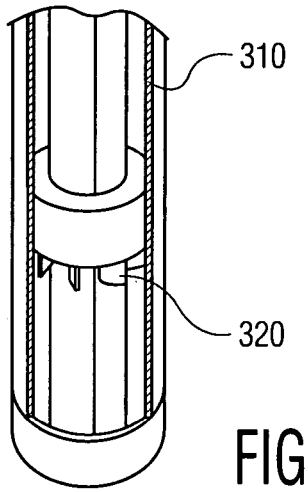
FIGS. 3*b* and 3*c* are partial cutaway isometric views of a lamp socket hole and pin electrode of the present invention.
Figure 3C:
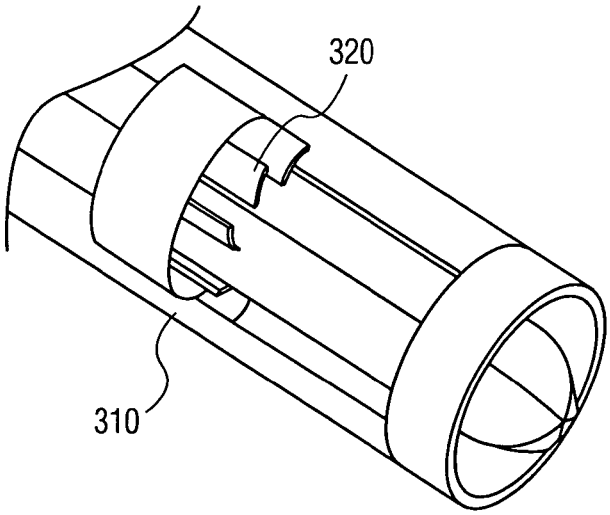
Figure 3D:
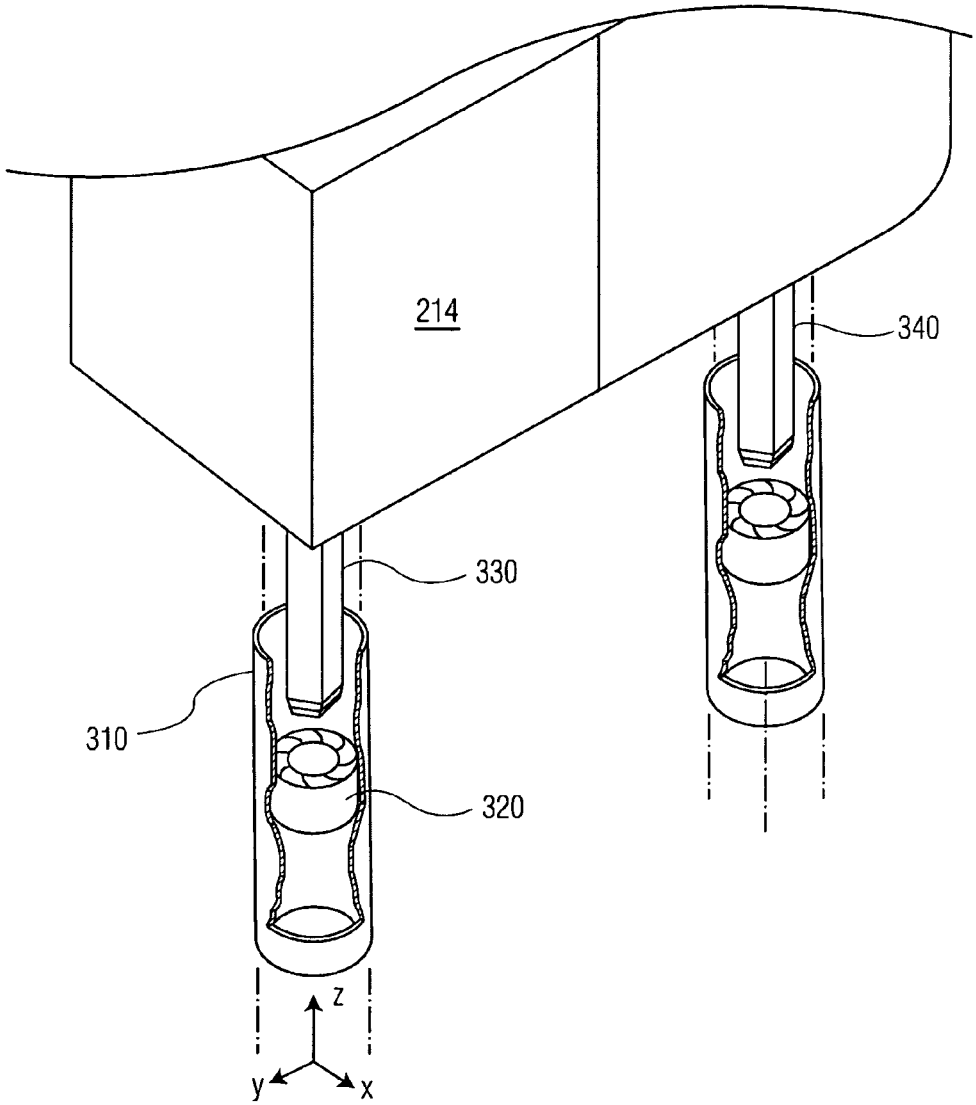
FIG. 3*d* is an enlarged perspective view of a lamp assembly system wherein the lamp is received by lamp socket holes.

Referring now to FIG. 3*a*, a partial cross-sectional view of the lamp socket assembly 228 taken along line 3*a* is shown. Assembly 228 contains two socket holes 310 to receive lamp electrodes 330 and 340 (see FIG. 3*d*). Bulkhead 240 (of FIG. 2), however has openings in it to allow removal of lamp 214 from lamp socket hole 310. FIGS. 3*b* through 3*d* further illustrate how pin electrodes 330 and 340 are received by socket holes 310. Holes 310 contain spring contact assemblies 320 to provide proper alignment of pin electrodes 330 and 340 and to provide an electrical interconnect between lamp 214 and PCB 236 (of FIG. 2). Proper alignment will continually be affected by forces imparted by the reflector sleeve 212 (FIG. 2) on lamp collar 216 during beam-spread adjustments. Therefore, spring contact assemblies 320 allow for circular movements in an X-Y plane to precisely align lamp 214 along reflector's 210 axis of optical symmetry.

Figure 4:
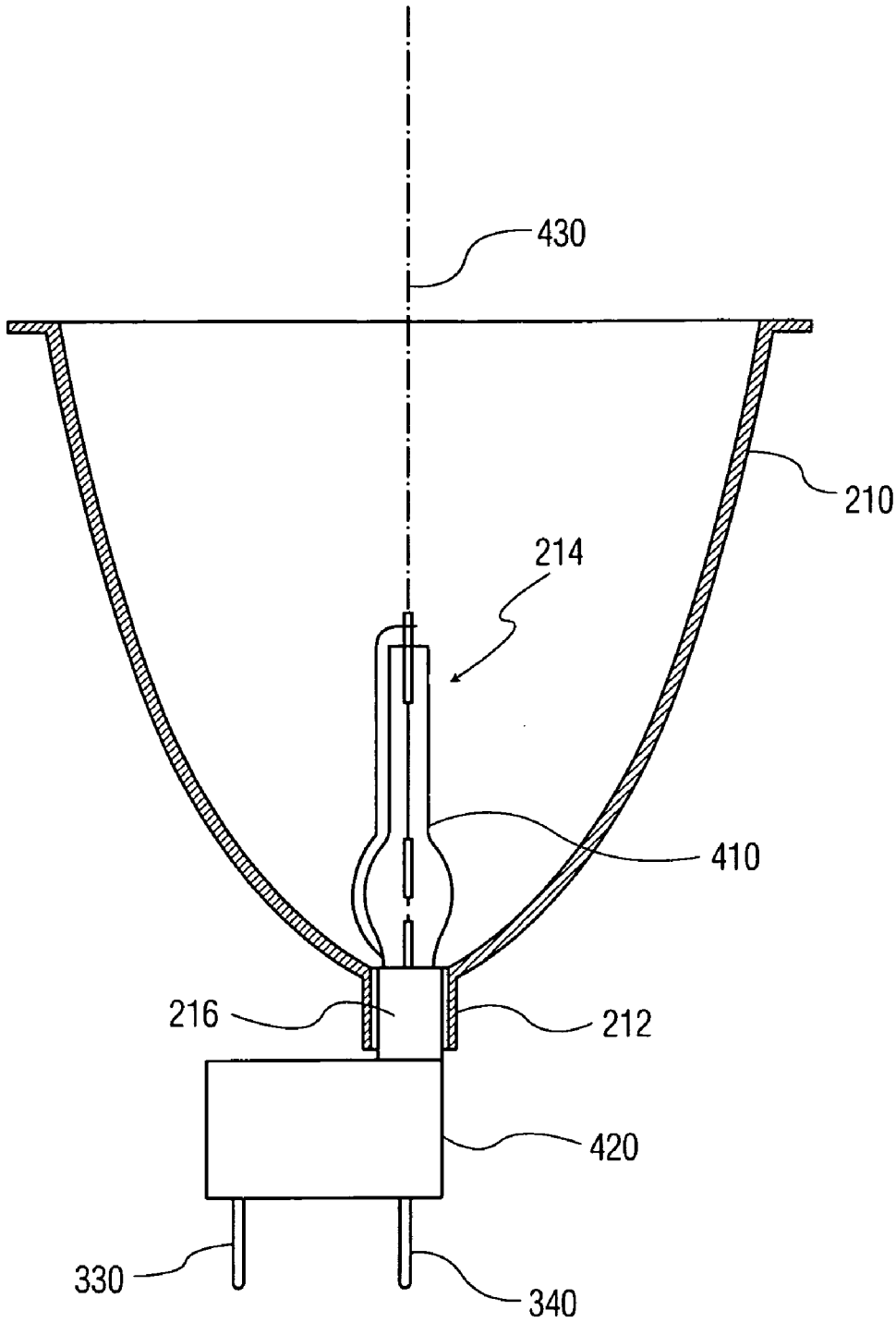
FIG. 4 is a side plane view of a lamp of the present invention as configured with a sectional view of a reflector of the present invention.
Figure 5A:
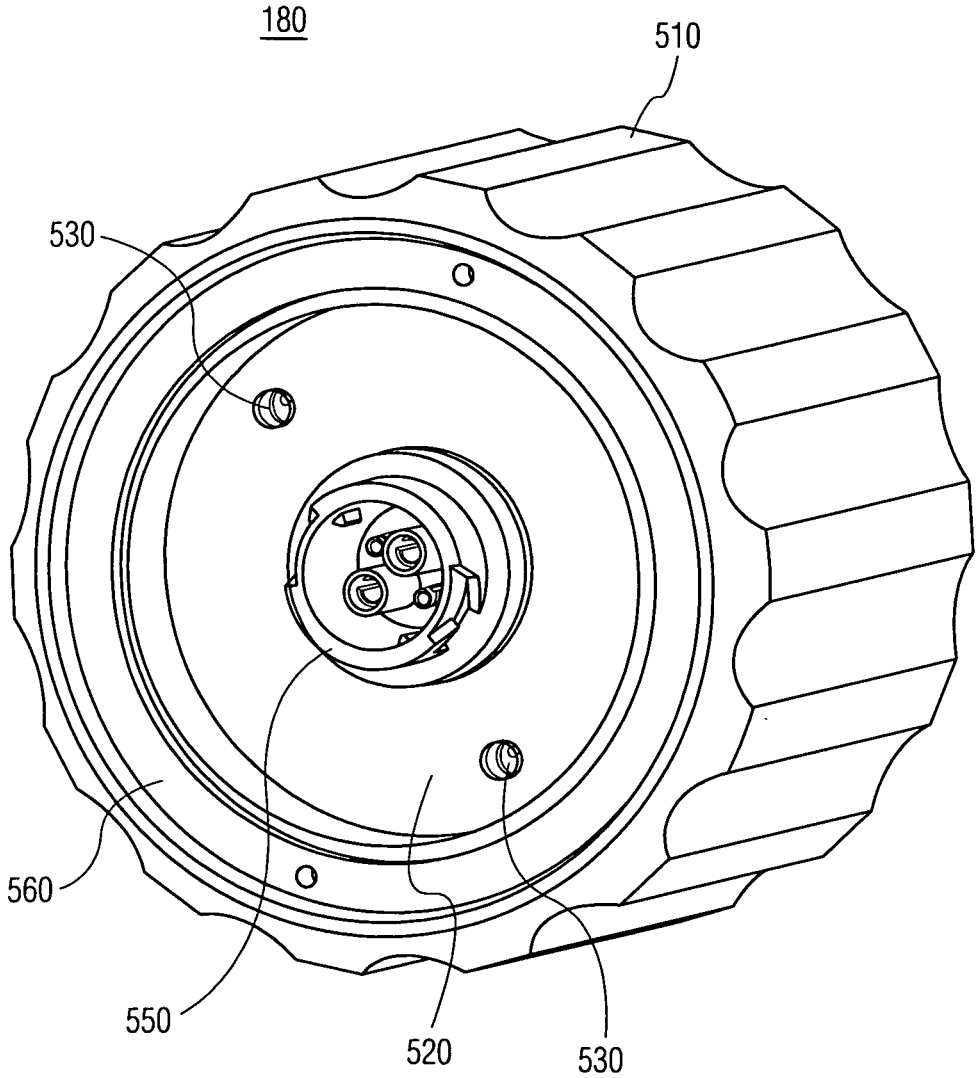
FIG. 5A is an isometric view of an embodiment of an end cap assembly of the present invention.
Figure 5B:
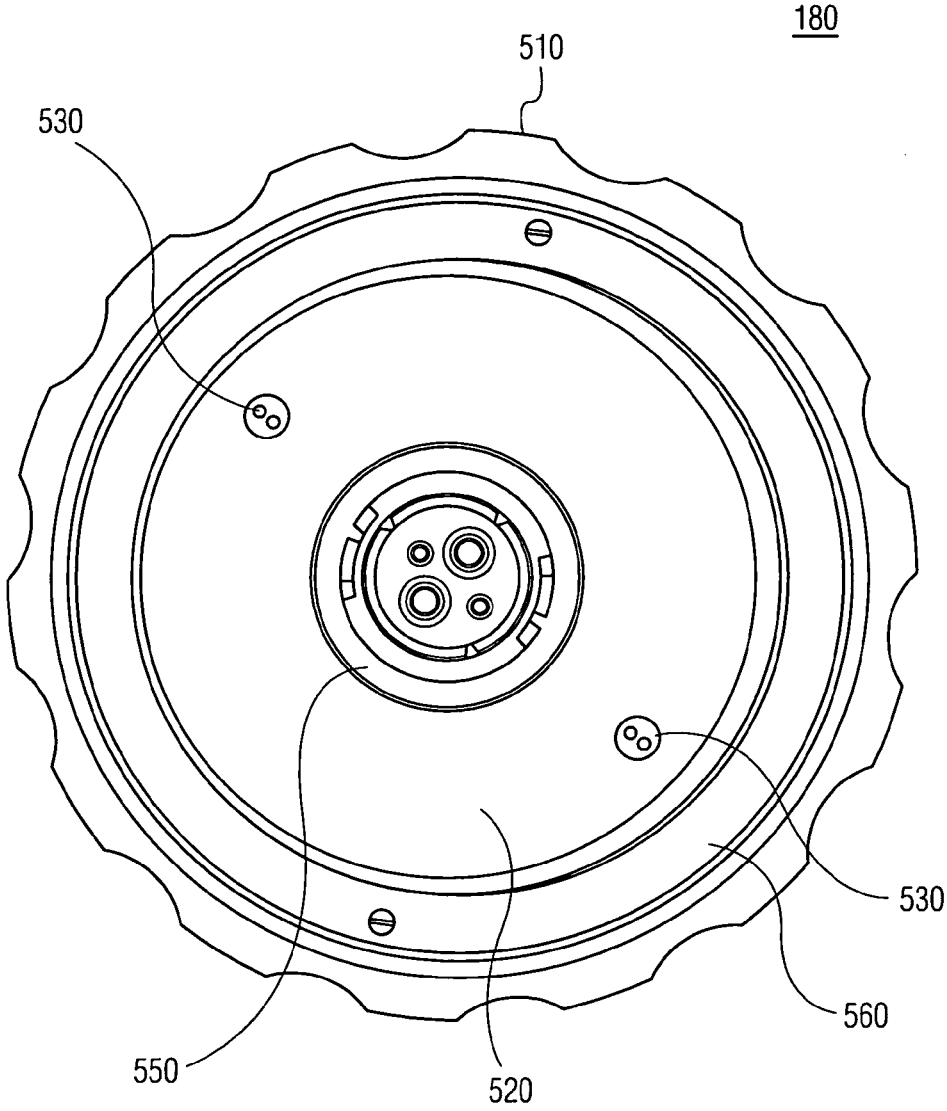
FIG. 5B is an end view of the end cap assembly of FIG. 5A.
Figure 5C:
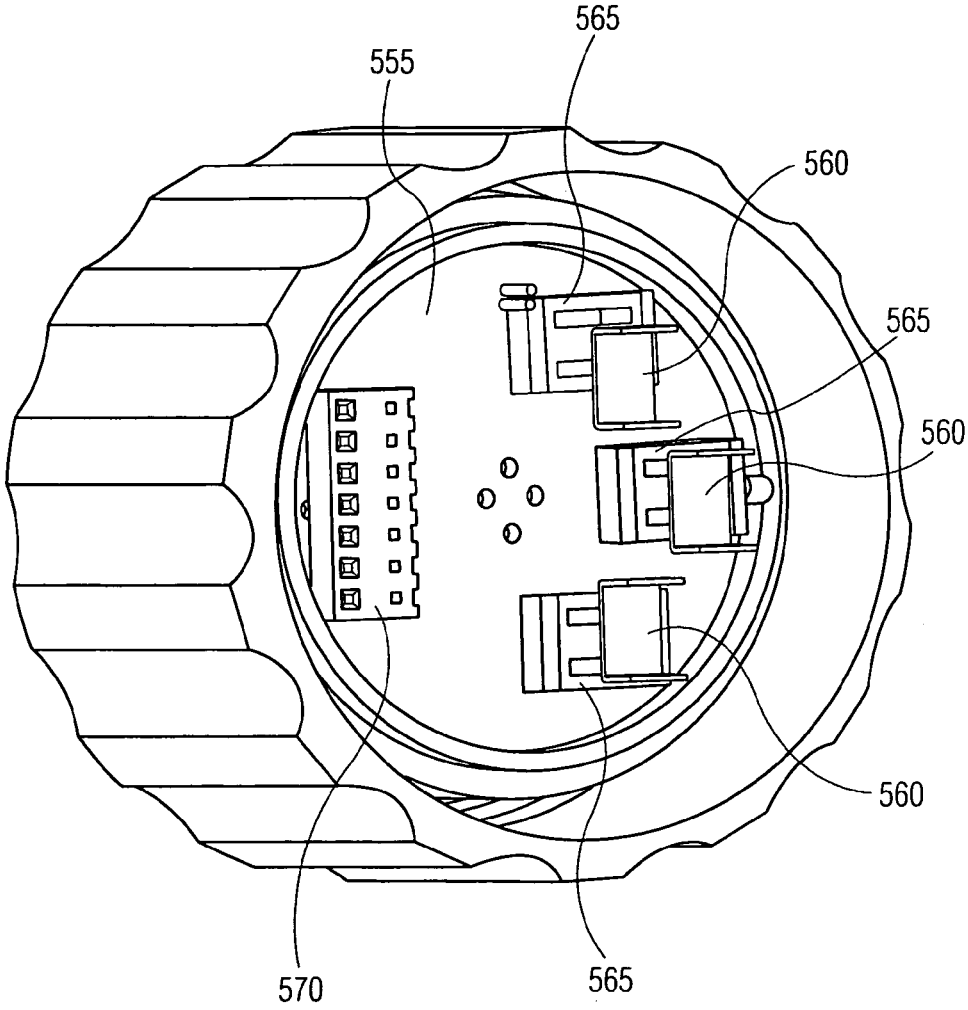
FIG. 5C is another isometric view of the end cap assembly of FIG. 5B.
Figure 5D:
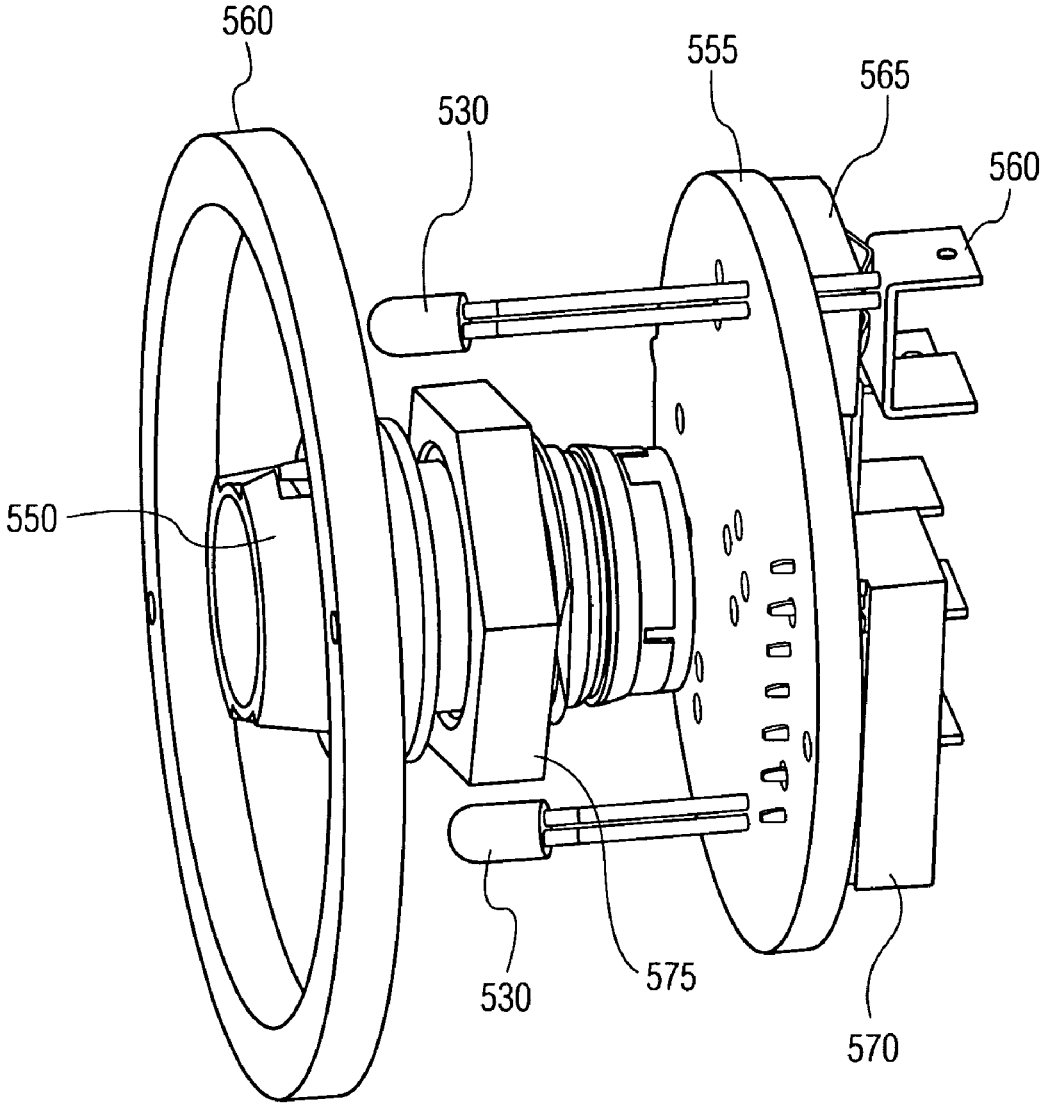
FIG. 5D illustrates the internal components of the end cap assembly of FIG. 5A with the housing and end cap ring removed.
Figure 6A:
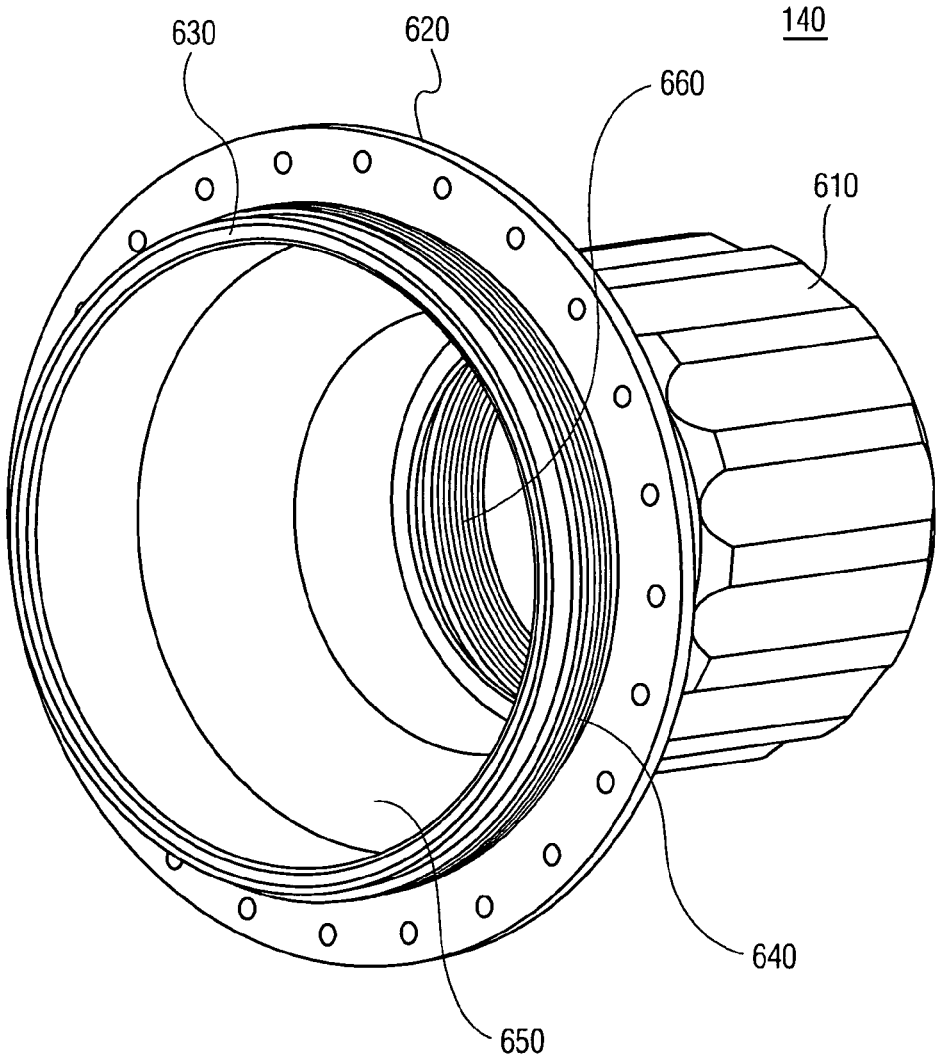
FIG. 6A is an isometric view of an embodiment of the head of the present invention.
Figure 6B:
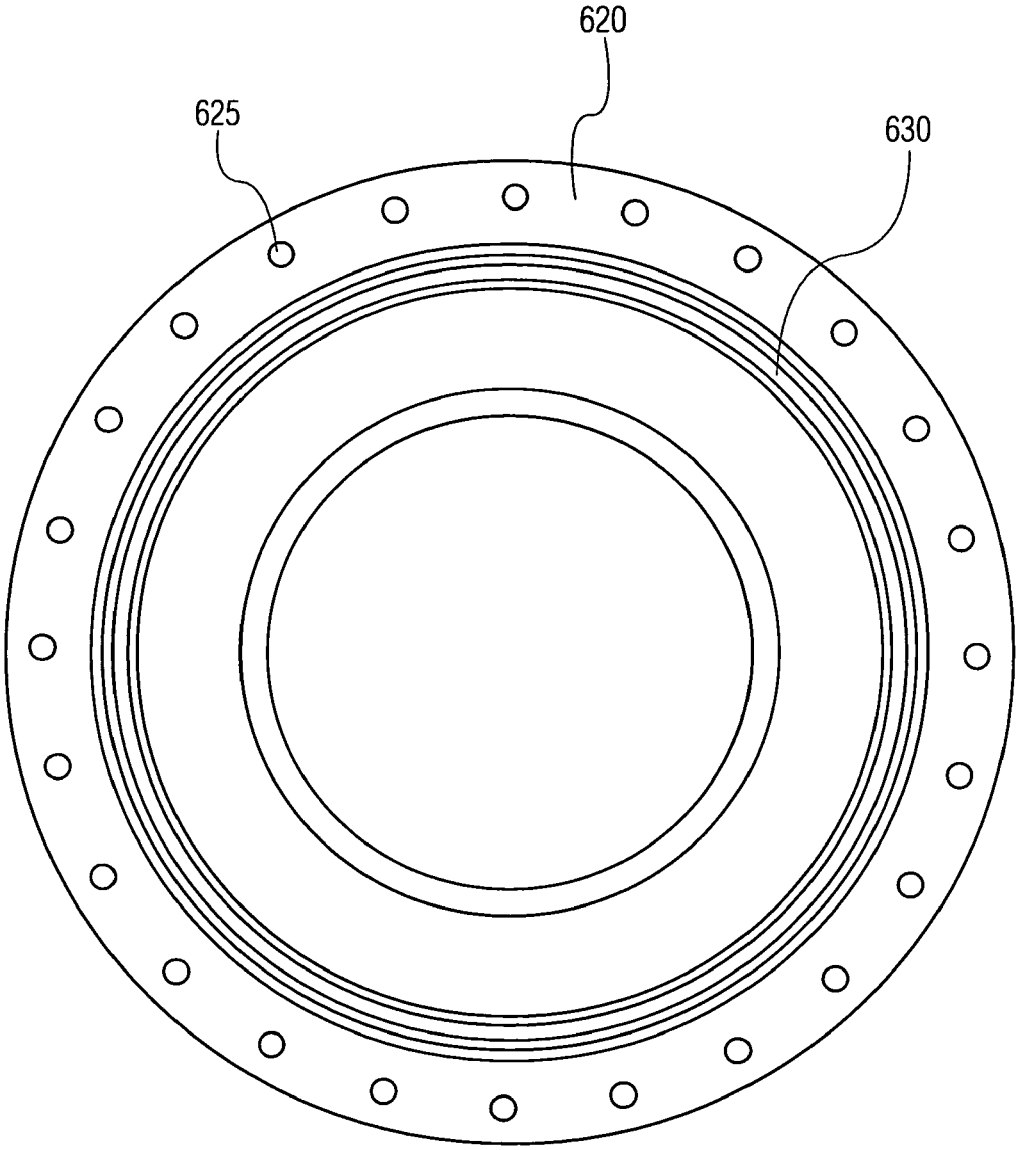
FIGS. 6B and 6C are a front view and a side view, respectively, of the head of FIG. 6A.
Figure 6C:
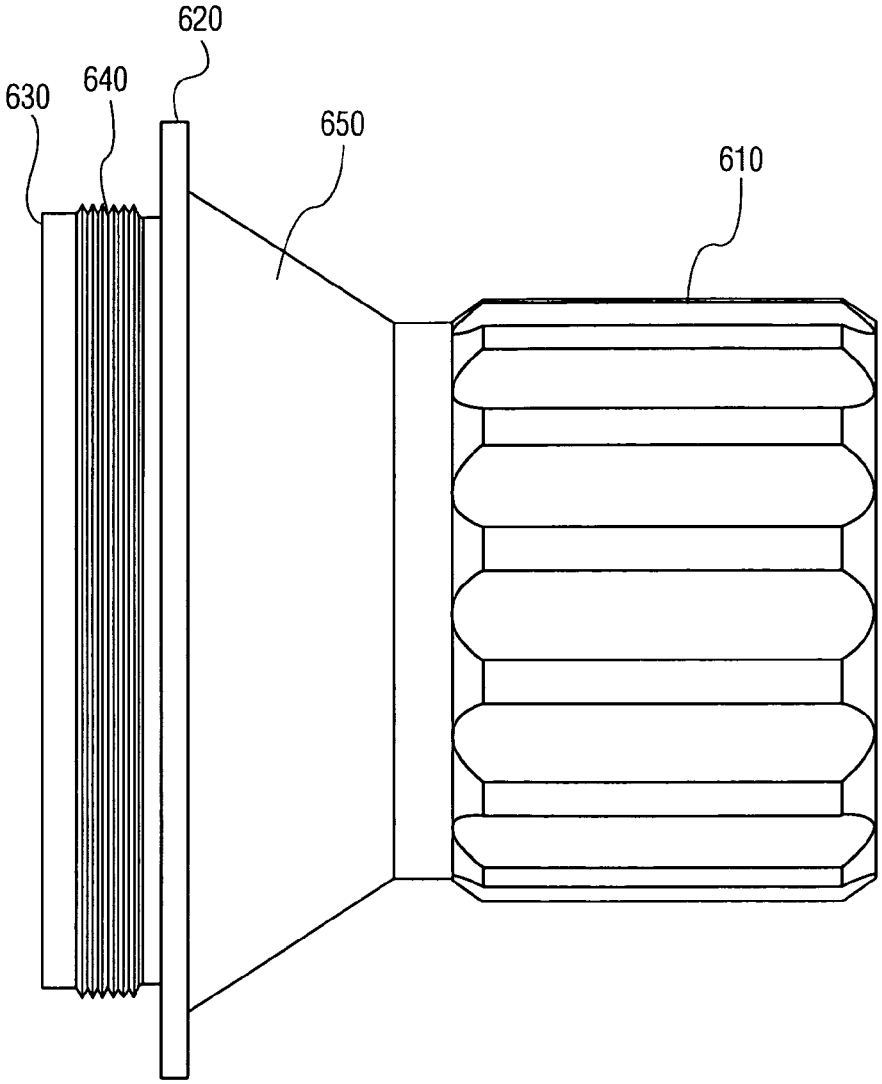
Figure 6D:
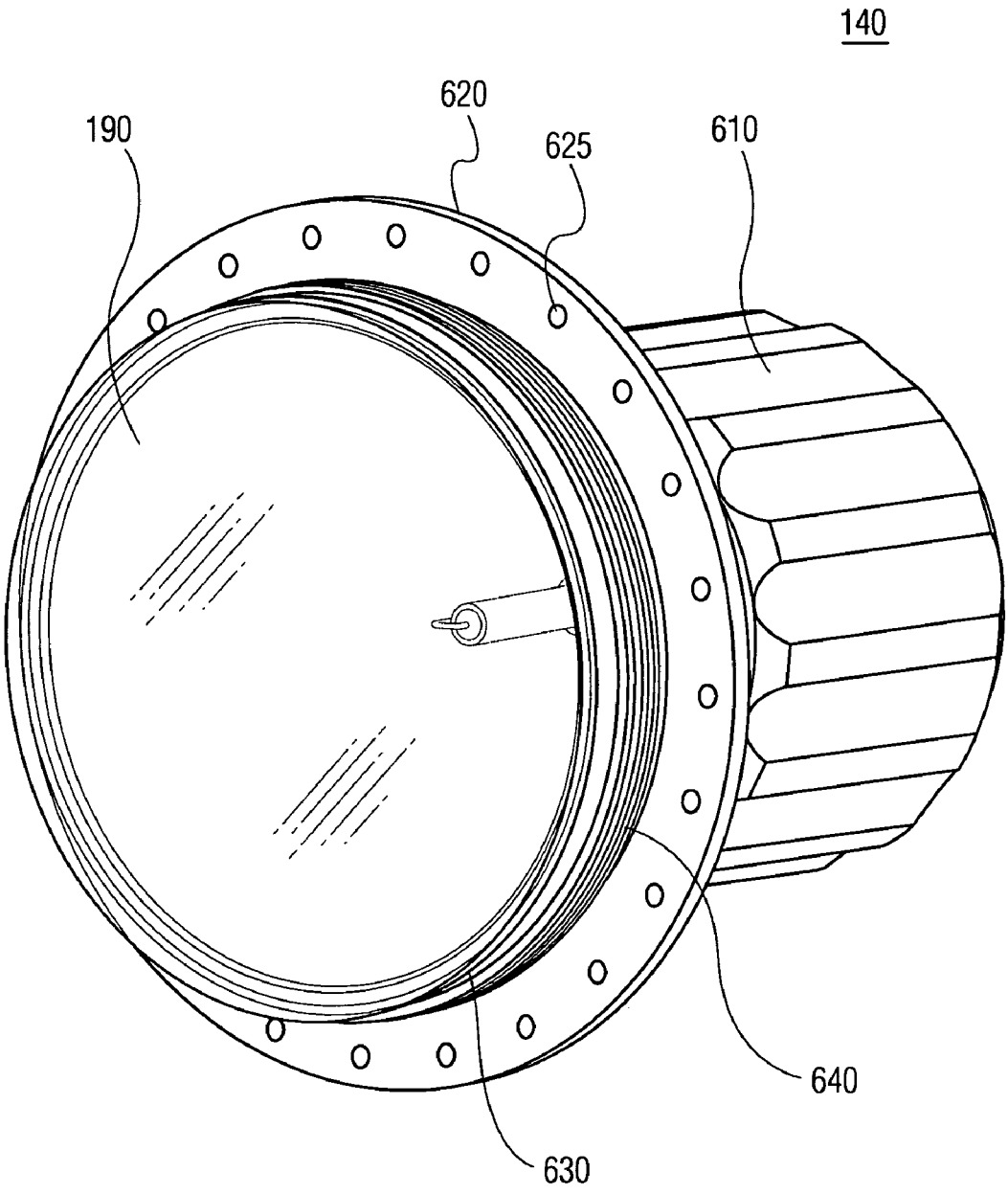
FIG. 6D illustrates a glass window mounted on the head of FIG. 6A.
Figure 6E:
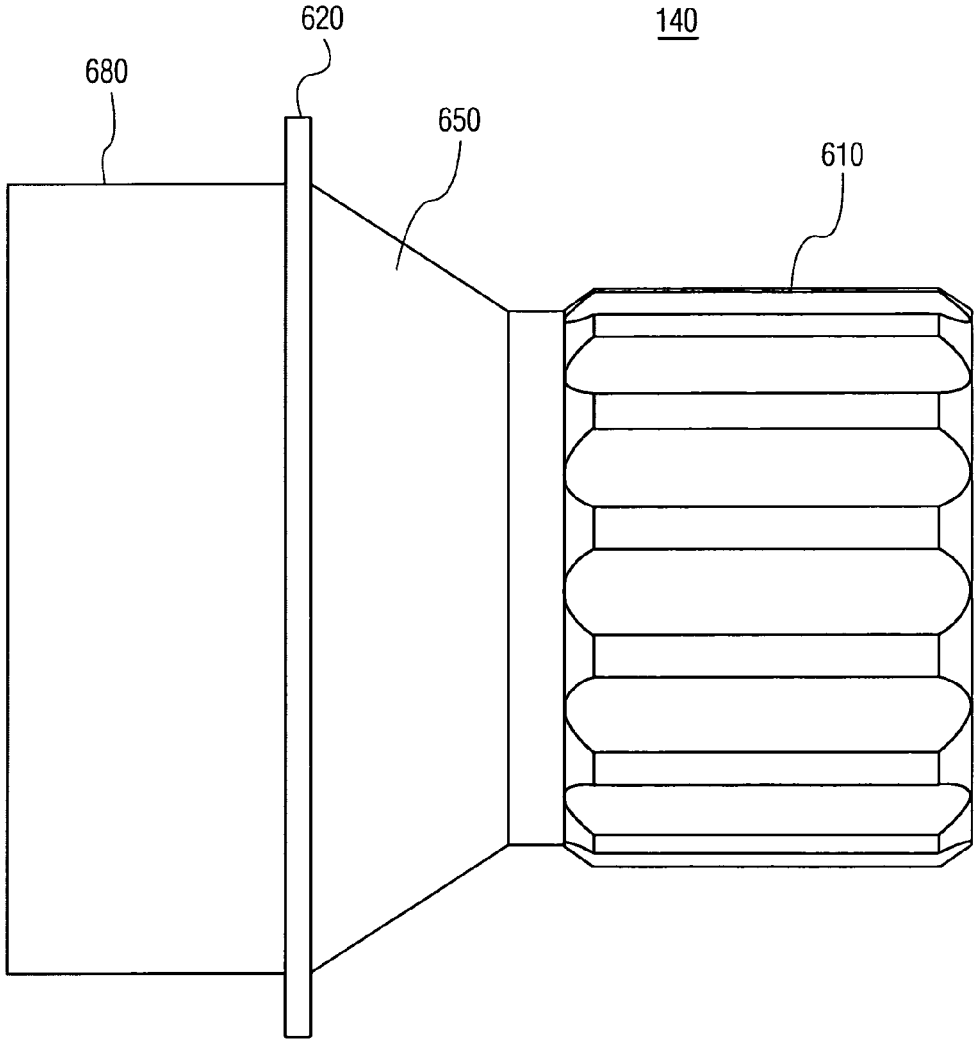
FIG. 6E is a side view of bezel ring mounted on the head of FIG. 6A.
Figure 6F:
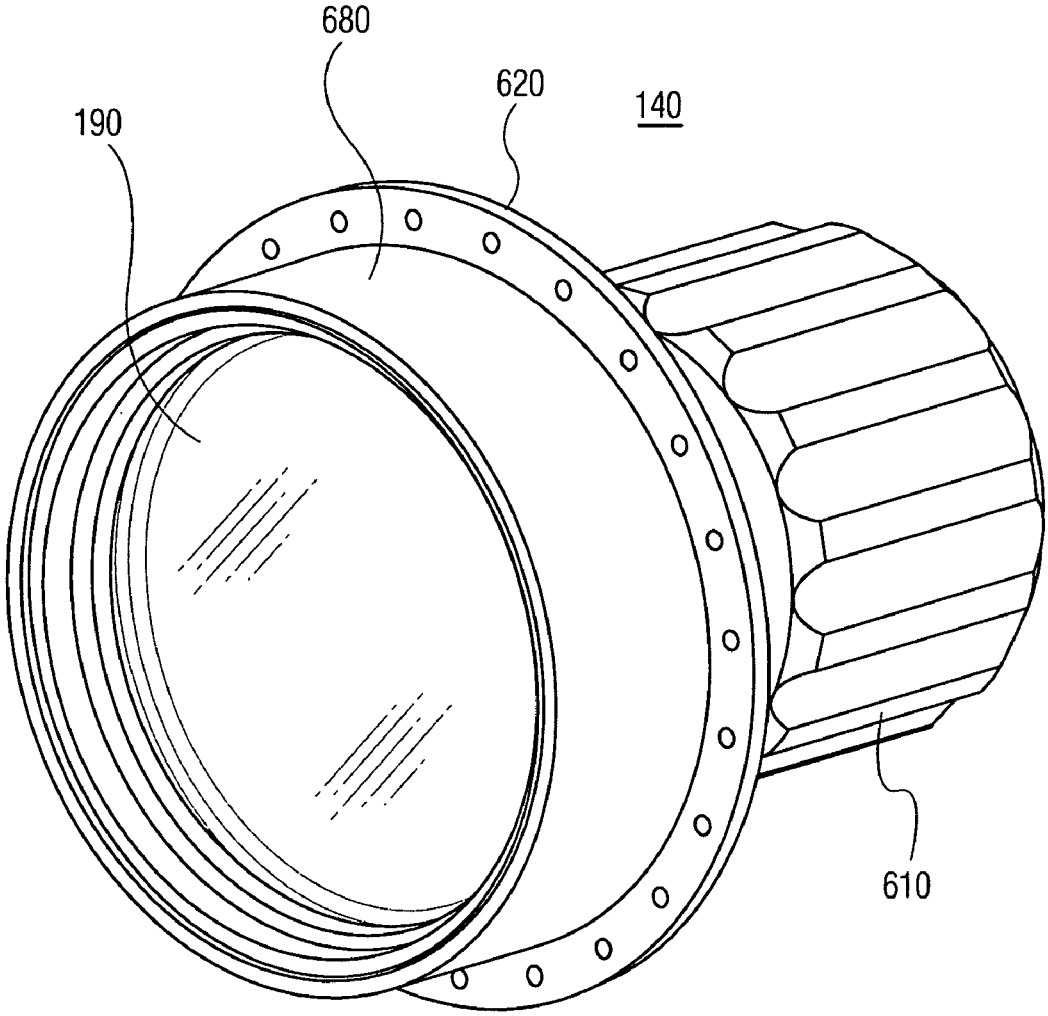
FIG. 6F is an isometric view of bezel ring holding the glass window of FIG. 6D.

Referring to FIG. 4, a side plane view of a lamp 214 of the present invention is shown, as configured with a sectional view of a reflector 210 of the present invention. Reflector 210 has a collar 212 disposed around a cylindrical neck portion 216 of lamp 214. Collar 212 defines an aperture which is adapted to accommodate a high intensity lamp 214. Collar 212 and neck 216 are designed to maintain a close interface between the two so that lamp 214 is maintained centered and aligned with respect to the optical axis of symmetry 430. The close interface should also allow axial movement between lamp 214 and reflector 210 while changing beam spread of the hand held searchlight. Additionally, the close interface is maintained so that it provides a path for heat transfer from lamp 214 to the reflector 210. Reflector 210 is coupled to head 140 (of FIG. 1A) to further dissipate heat generated in lamp 214. By way of reference, the electrodes 330, 340 (of FIG. 3*d*) extend from a base portion 420 of lamp 214. FIG. 4 also illustrates the single-ended design of the lamp, allowing electrodes 330 and 340 to be physically located adjacent to one another rather than on opposing sides of lamp 214. Glass envelope 410 is also illustrated.

Figure 9A:
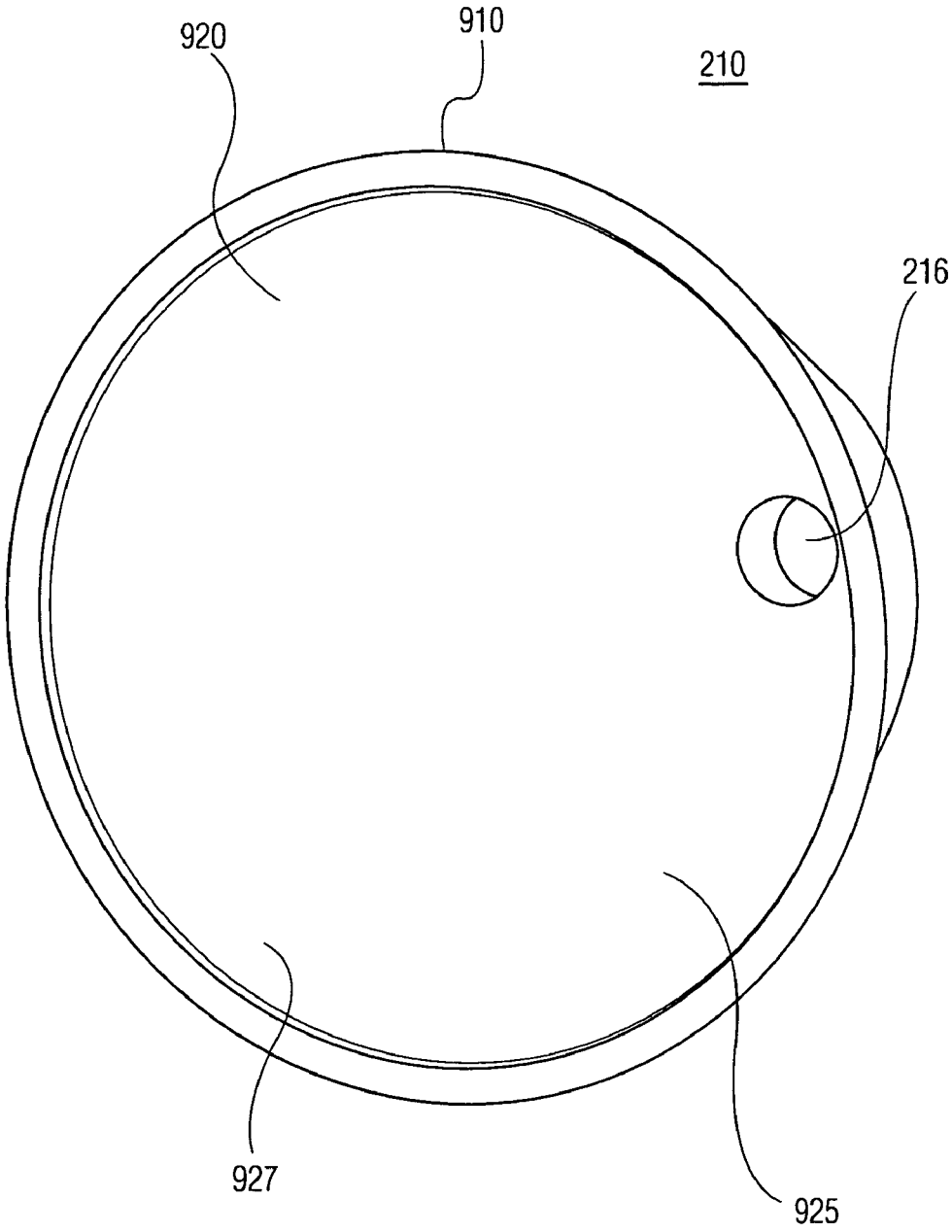
FIG. 9A is an isometric view of an exemplary embodiment of the parabolic reflector of the present invention.
Figure 9B:
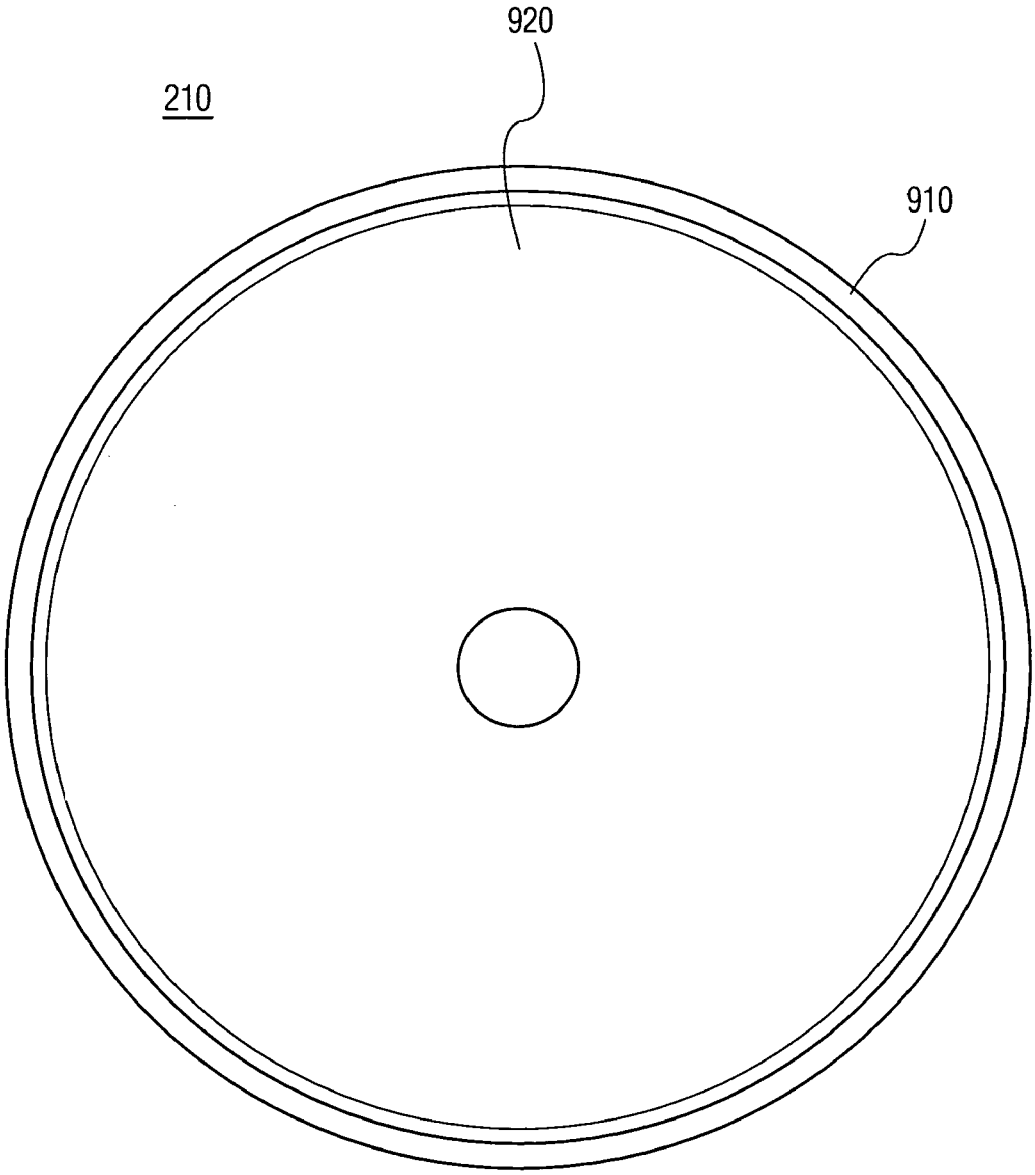
FIGS. 9B-9C are a front view and a side view, respectively, of the parabolic reflector of FIG. 9A.
Figure 9C:
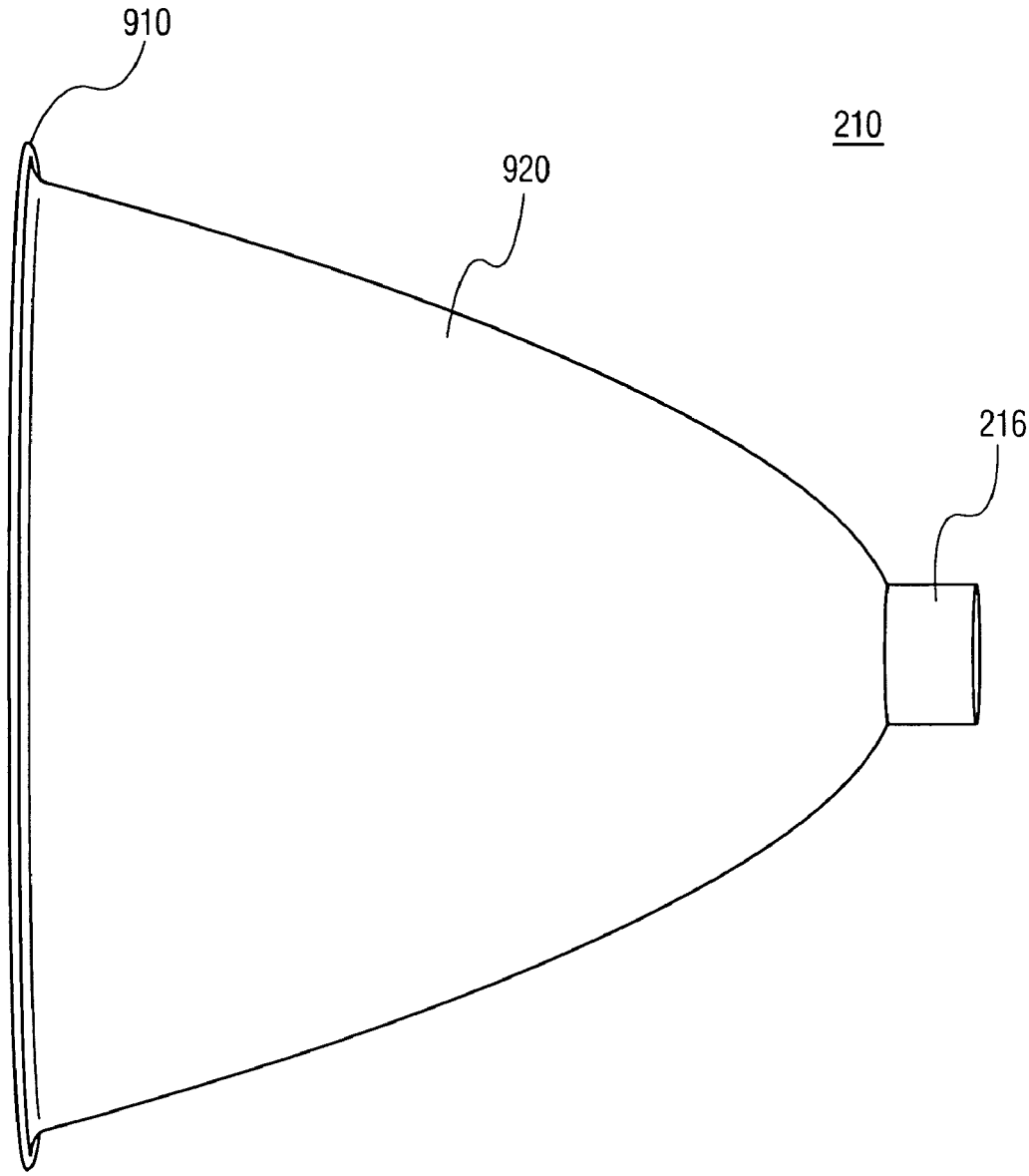

Now referring to FIGS. 9A-9C, an exemplary embodiment of parabolic reflector 210 is illustrated. Reflector 210 has a collar 216, a parabolic body 920, and a flange 910. Collar 216 is concentric with the axis of revolution of parabolic body 920. A coating 927 on inner surface 925 of parabolic body 920 is even and consistent. Coating 927 has reflectivity for both visible and infrared light. Such coatings are known in the art and therefore are not described in further detail for sake of brevity.

Referring now to FIGS. 5A-5D, an end cap assembly 180 for an embodiment of handheld searchlight 100 is illustrated. Assembly 180 includes an end cap housing 520, an end cap housing retaining ring 560, an end cap ring 510, and an LED assembly 530. Housing retaining ring 560 holds housing 520. End cap ring 510 couples mechanically with housing 110 (of FIG. 1). In an exemplary embodiment, housing 110 (of FIG. 1) may have external threads and ring 510 may have corresponding internal threads.

Still referring to FIGS. 5A-5D, a pin body 550 passes through end cap housing 520. Pin body 550 is adapted to couple to an external electric power supply (not shown). In an exemplary embodiment, pin body 550 is coupled to end cap housing 520 with a nut 575 (of FIG. 5D). Assembly 180 further includes a PCB end cap 555. PCB end cap 555 has a plurality of contact springs 565 and corresponding battery contacts 560. Pin body 550 electrically couples with the battery contacts 565 and supplies power and/or recharges batteries 1040 (of FIG. 10) via wiring (not shown) associated with PCB end cap 555.

Referring now to FIGS. 6A-6E, an embodiment of a head 140 of the handheld searchlight 100 is illustrated. Head 140 includes a cylindrical section 610, a frusto-conical section 650, a flange 620 and a ring section 630. Cylindrical section 610 mechanically couples with housing 110. In an exemplary embodiment, section 610 has internal threads 660 which engage with corresponding external threads (not shown) on housing 110. Head 140 may be easily uncoupled from housing 110 by rotating along the external threads (not shown) on housing 110. This provides easy access to lamp 214 and facilitates easy removal and replacement of lamp 214 in the field. No special tools are thus needed for replacing lamp 214.

Frusto-conical section 650 is adapted to accommodate and engage reflector 210 (of FIG. 2). Section 650 may engage reflector 210 via, for example, an O-ring (not shown) and ball and spring plungers (not shown). A window or lens 190 (of FIG. 6D) is mounted on ring section 630 of head 140. A bezel ring 680 (of FIG. 6E) is coupled to ring section 630 of head 140 and is supported by flange 620. Bezel ring 680 (of FIG. 6E), mounted to ring section 630, holds window 190. In an exemplary embodiment, window 190 is a glass window. Other transparent material may also be used for window 190. Flange 620 further supports rotatable bezel ring 150 (of FIG. 1).

Now will be described how the spread of the high-intensity beam may be easily changed to suit the requirements in the field. A user holds handheld searchlight 100 in one hand and rotates head 140 about housing 110 with the other hand. As head 140 rotates about housing 110, reflector 210 (of FIG. 2) moves along the optical axis 430 (of FIG. 4) relative to lamp 214 (of FIG. 2). Thus, spread of handheld searchlight 100 can be adjusted for any mode between a flood lighting mode to a spot lighting mode and any intermediate lighting modes as deemed useful by a user. In the flood lighting mode, the light beam is widely dispersed covering a larger area, whereas in spot lighting mode, the light beam is narrowly focused on a relatively smaller area. Such movement of head 140, and consequently of reflector 210, helps in adjusting the reflector position so that full luminance distribution of the arc of a high-intensity lamp, for example a xenon arc lamp, is in the high magnification section of parabolic reflector 210 and thus produces a more concentrated beam in the near-and-far-field and hence greater range is achieved. Additionally, when the beam is diffused into a flood pattern no characteristic "black hole" of prior art configurations is produced. These adjustments may be easily made in the field while handheld searchlight 100 is in use, without powering down handheld searchlight 100 or taking apart any component of handheld searchlight 100.

Again referring to FIGS. 6A-6E, rotatable bezel ring 150 is adapted to be selectively engageable with head 140. Rotatable bezel ring 150 may be held in a steady position relative to head 140. Upon application of force, rotatable bezel ring 150 may rotate about head 140 to a different position. Rotation of rotatable bezel ring 150 about head 140 may be continuous or in discrete steps. In an exemplary embodiment, rotatable bezel ring 150 is selectively engageable with head 140 via a ball and spring plunger 705 (of FIG. 7D). Ledge 620 includes detents 625 on a surface 622. Detents 625 are adapted to accommodate ball 717 (of FIG. 7D) of the plunger 705 (of FIG. 7D). In an exemplary embodiment, each of detents 625 is spaced apart equally from one another. By way of example only, there may be ten (10), fifteen (15), twenty (20), and twenty-three (23) detents on surface 622 of ledge 620. Such an arrangement of ball and spring plunger 705 holds rotatable bezel ring 150 firmly in a given position, but upon application of a force above a predetermined threshold, allows rotatable bezel ring 150 to rotate about bezel ring 680 to any one of selective positions, in increments determined by the distance between any two of detents 625. The plurality of selective positions corresponds to plurality of detents 625.

Figure 7A:
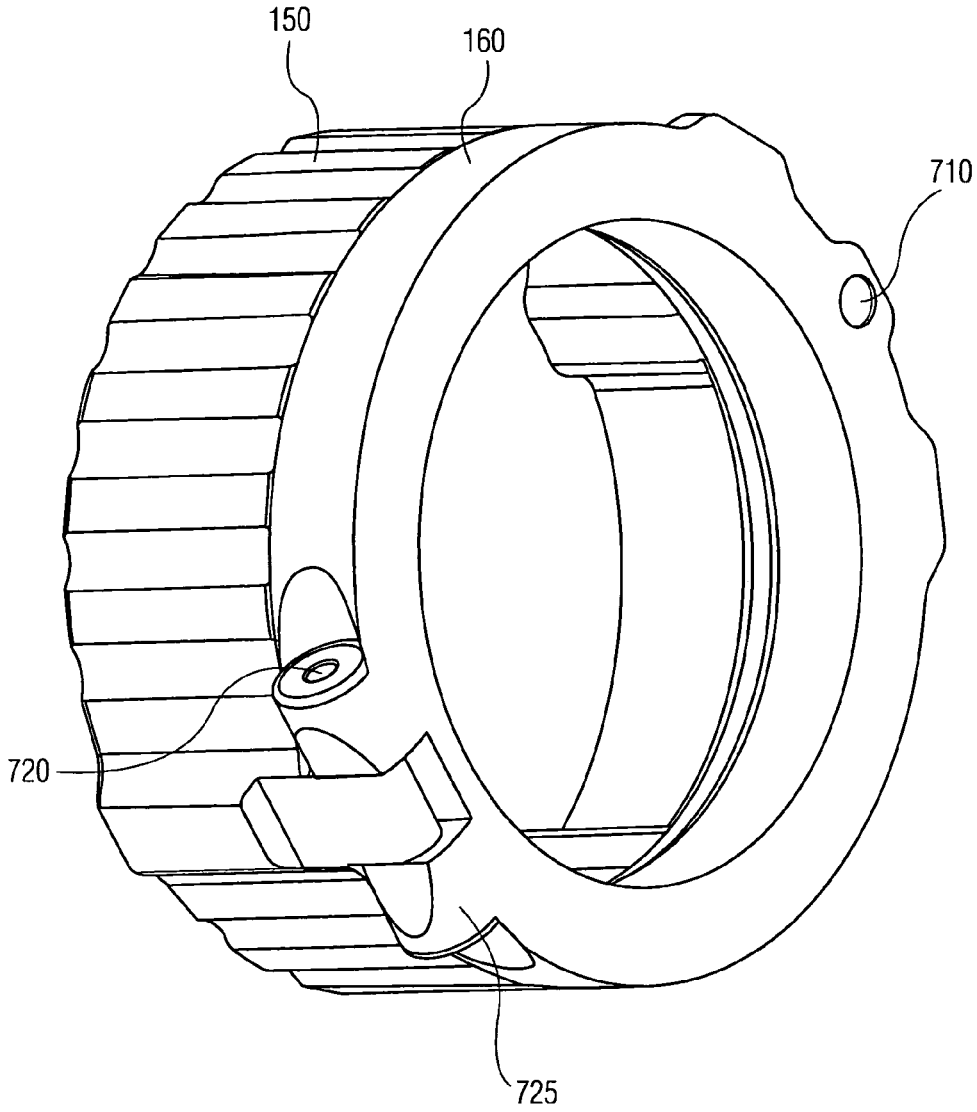
FIG. 7A is an isometric view of the assembly of the rotatable bezel ring and the filter ring mount, according to an embodiment of the invention.
Figure 7B:
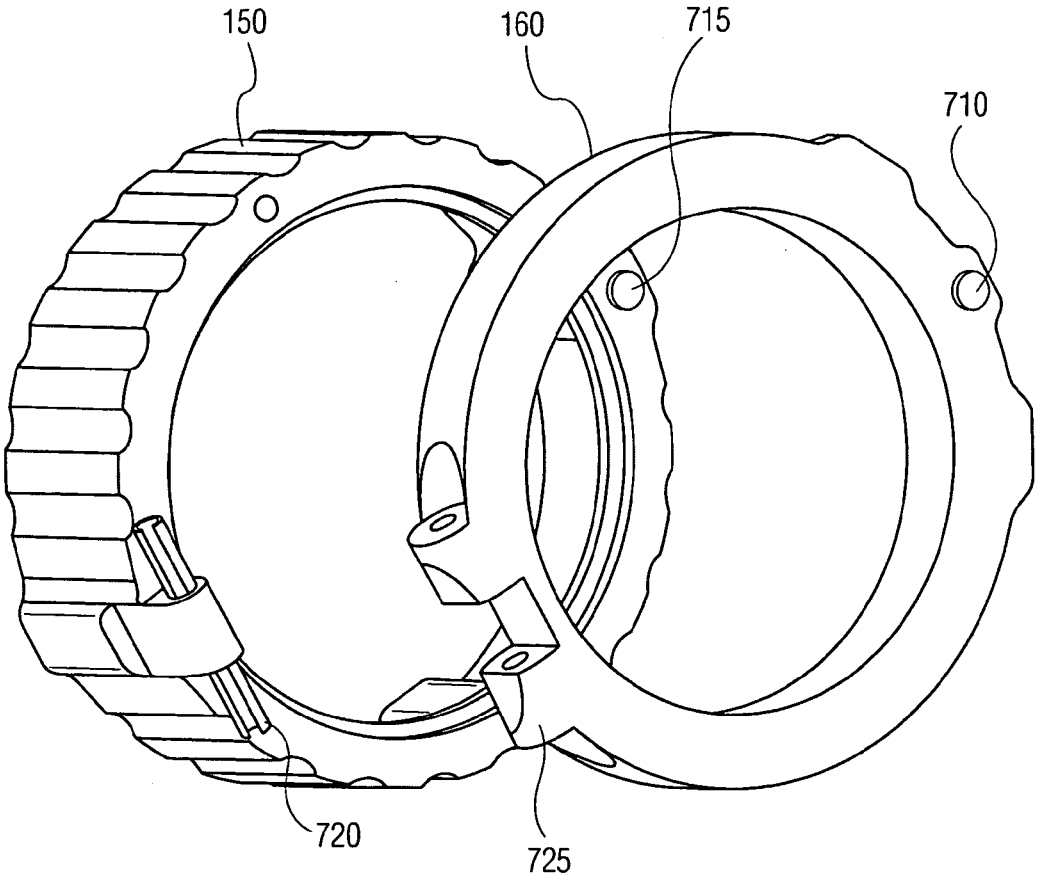
FIG. 7B is an exploded view of the assembly of FIG. 7A.
Figure 7C:
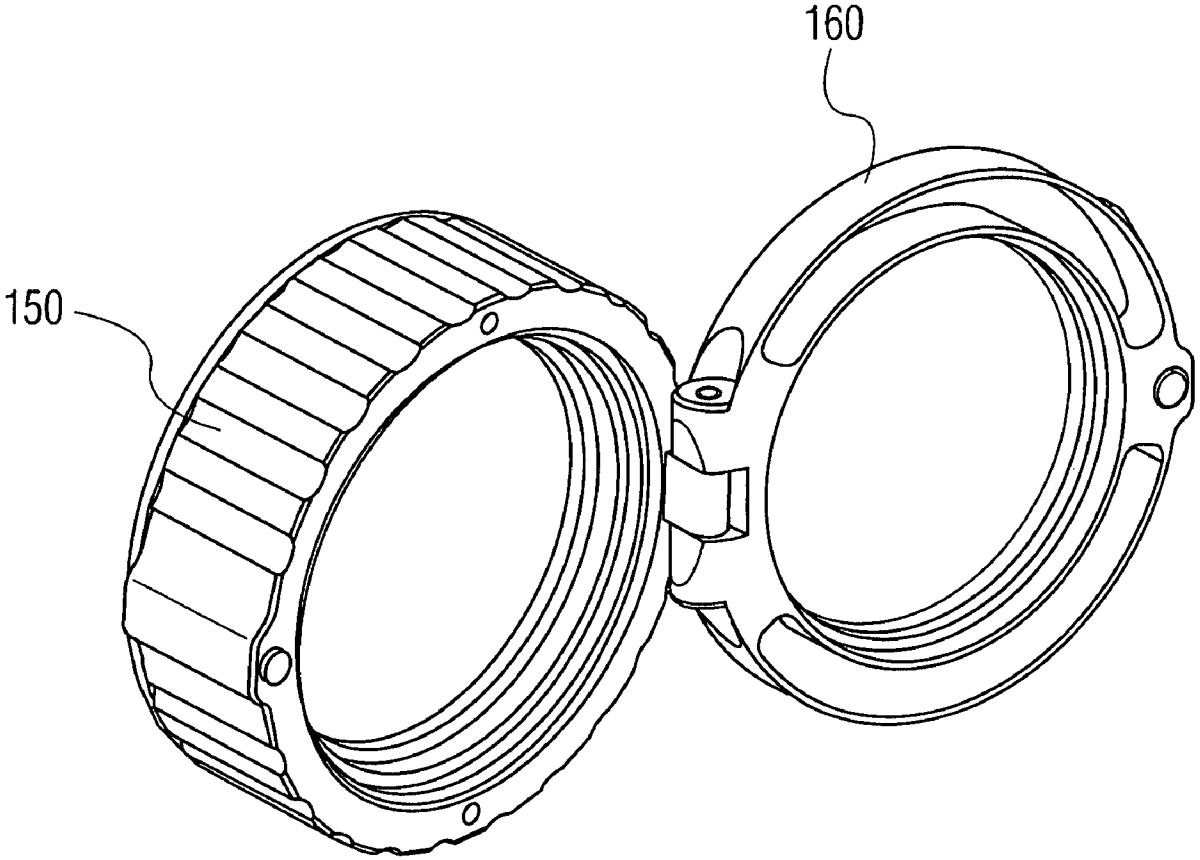
FIG. 7C illustrates a position of the filter mount ring relative to the rotatable bezel ring, both of FIG. 7A.
Figure 7D:
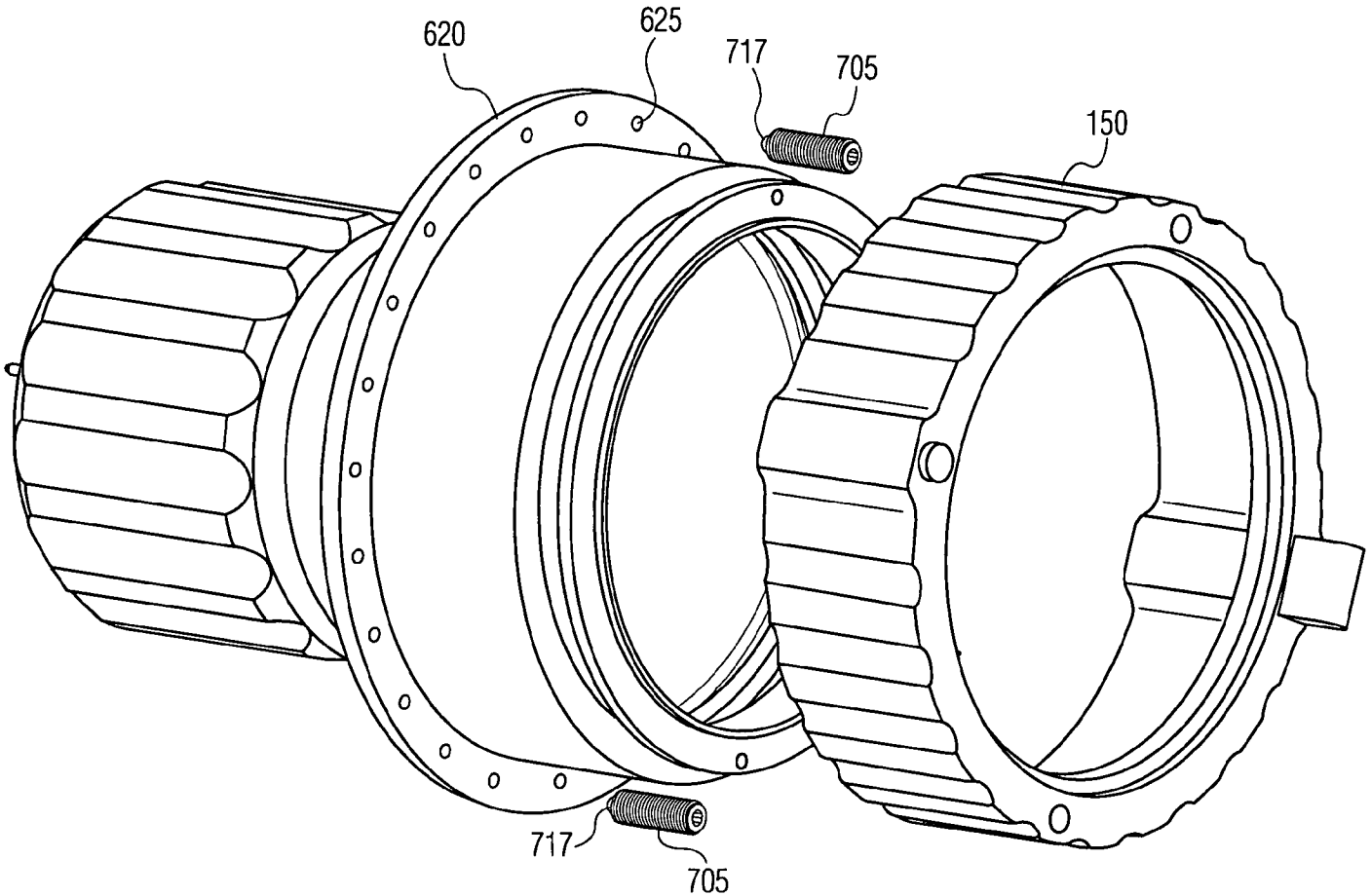
FIG. 7D illustrated an exploded view of the head, the spring and ball plungers, and the rotating bezel ring of an embodiment of the present invention.

Referring now to FIGS. 7A-7B, an assembly of rotatable bezel ring 150 and filter ring mount 160 is illustrated. Filter ring mount 160 is coupled with rotatable bezel ring 150 via a hinge member 720. A magnet 710 is mounted in filter ring mount 160. A corresponding magnet 715 is mounted in rotatable bezel ring 150. In the exemplary embodiment, magnets 710 and 715 are neodymium magnets and may be cylindrical in shape. Other shapes and magnet materials may also be used. Magnets 710 and 715 facilitate easy and complete covering of lens 190 with filter ring mount 160 by locking filter ring mount 160 tightly against rotatable bezel ring 150 and thus prevent accidental or unintended flipping of filter ring mount 160. A certain magnitude of force is required to overcome the magnetic fields of magnets 710, 715 to unlock or lift filter ring mount 160 off rotatable bezel ring 150. This force may be provided manually and/or via a servomotor (not shown), for example. Filter ring mount 160 can pivot about hinge member 720 in any position between a first position and a second position. In an exemplary embodiment, hinge member 720 may be a spring tension pin 725. Spring tension pin 725 exerts sufficient force upon filter ring mount 160 to maintain any position between and including the first and the second positions and requires application of a predetermined magnitude of force to change the position of filter ring mount 160 relative to rotatable bezel ring 150. In the first position, filter ring mount 160 is at least perpendicular to bezel ring 150 wherein window or lens 190 (of FIG. 1B) is completely uncovered and is completely outside the path of the high-intensity light beam from lamp 214. In an exemplary embodiment, filter ring mount 160 may be at about 180° to bezel ring 150. In the second position, filter ring mount 160 completely covers bezel ring 150, wherein window or lens 190 (of FIG. 1B) is also completely covered such that optical filter 170 in filter ring mount 160 is completely in the path of high-intensity light beam from lamp 214. Thus, hinge member 720 permits filter ring mount 160 a range of motion between the first position and the second position. FIG. 1A illustrates filter ring mount 160 in the first position in which optical filter 170 completely covers window 190 (of FIG. 1B). FIG. 1B illustrates filter ring mount 160 in an intermediate position in which optical filter 170 completely uncovers window 190. FIG. 7C illustrates filter ring mount 160 at about 180° to bezel ring 160.

Handheld searchlight 100 may also be mounted on or used with a viewing device, camera or a weapon. During such use, if there is an external obstruction which would prevent the flipping of filter ring mount 160 in a particular location of handheld searchlight 100, rotatable bezel ring 150 may rotated to a position where filter ring mount 160 may be flipped open with any hindrance from the external obstruction.

Figure 8:
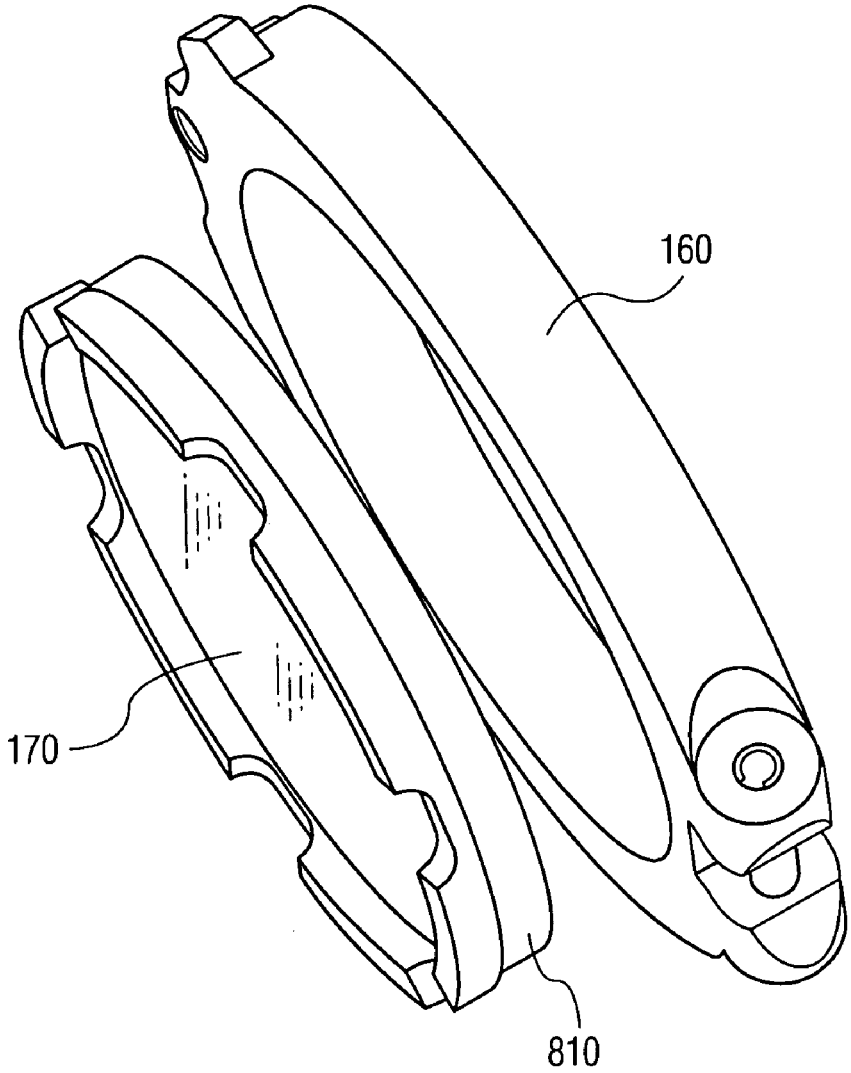
FIG. 8 is an exploded view of the filter ring mount and the filter ring of FIG. 1A.

Now referring to FIG. 8, filter ring mount 160 and a filter ring 810 are illustrated. Optical filter 170 is mounted in filter ring 810. Filter ring 810 is replaceably mounted in filter ring mount 160. Such an assembly facilitates easy removing and installing of optical filter 170 on handheld searchlight 100 in the field. Optical filters can be easily replaced, if broken, for example, or if a different kind of optical filter is required. The beam output is thus usable with a variety of optical filters to allow varied intensity and wavelengths for a particular application, such as smoke filled environments, infrared illuminations and underwater illuminations. In an exemplary embodiment, filter ring 810 may have external threads and filter ring mount 160 may have corresponding internal threads. Filter ring 810, may thus be thread-mounted in filter ring mount 160 as per an aspect of the invention. Since rotatable bezel ring 150 rotates filter ring mount 160, polarized optical filters may also be used with handheld searchlight 100.

Figure 10A:
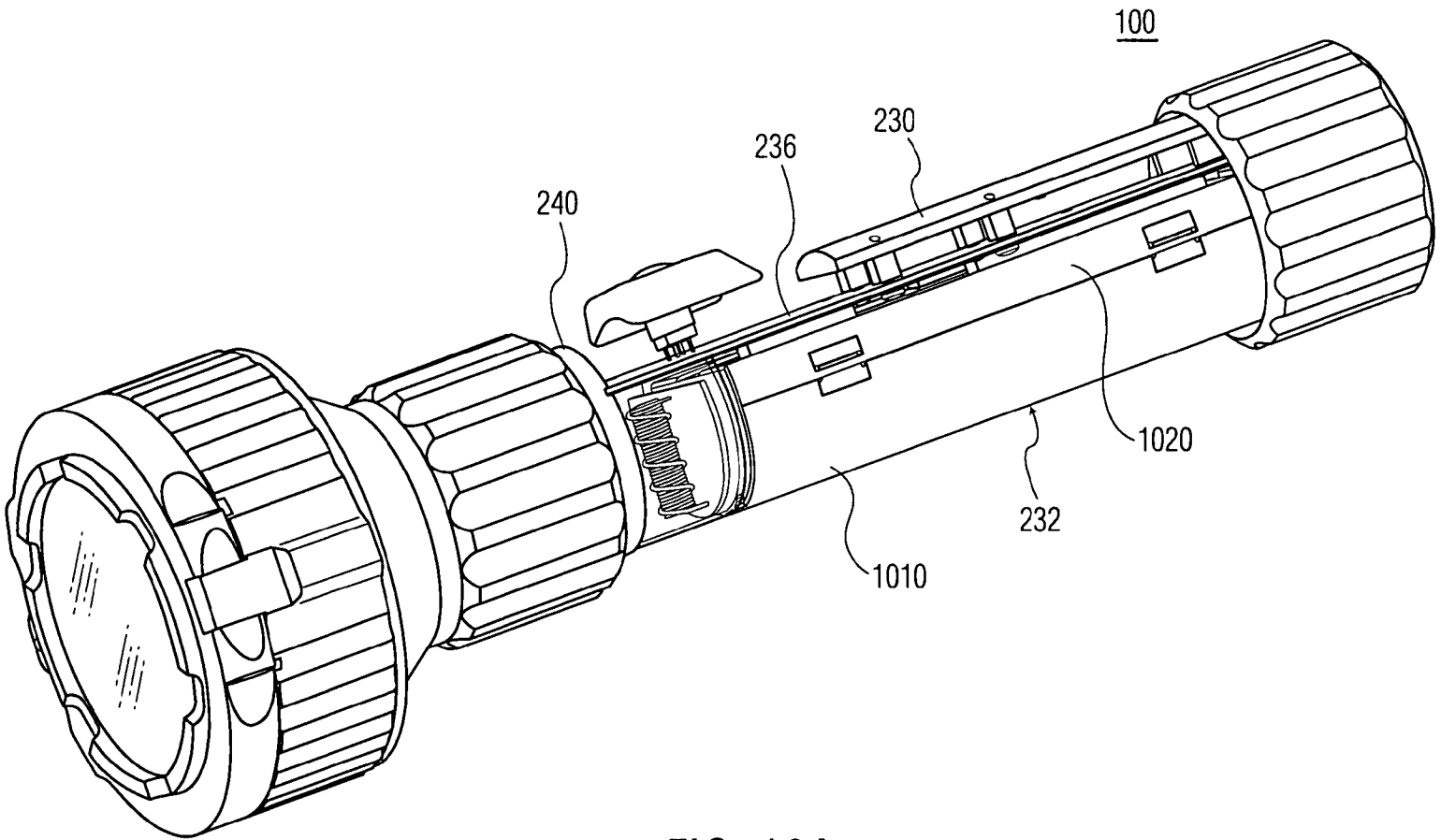
FIG. 10A illustrates the handheld searchlight of FIG. 1 with the housing removed and illustrates a printed circuit board, a heat sink and a battery pack.
Figure 10B:
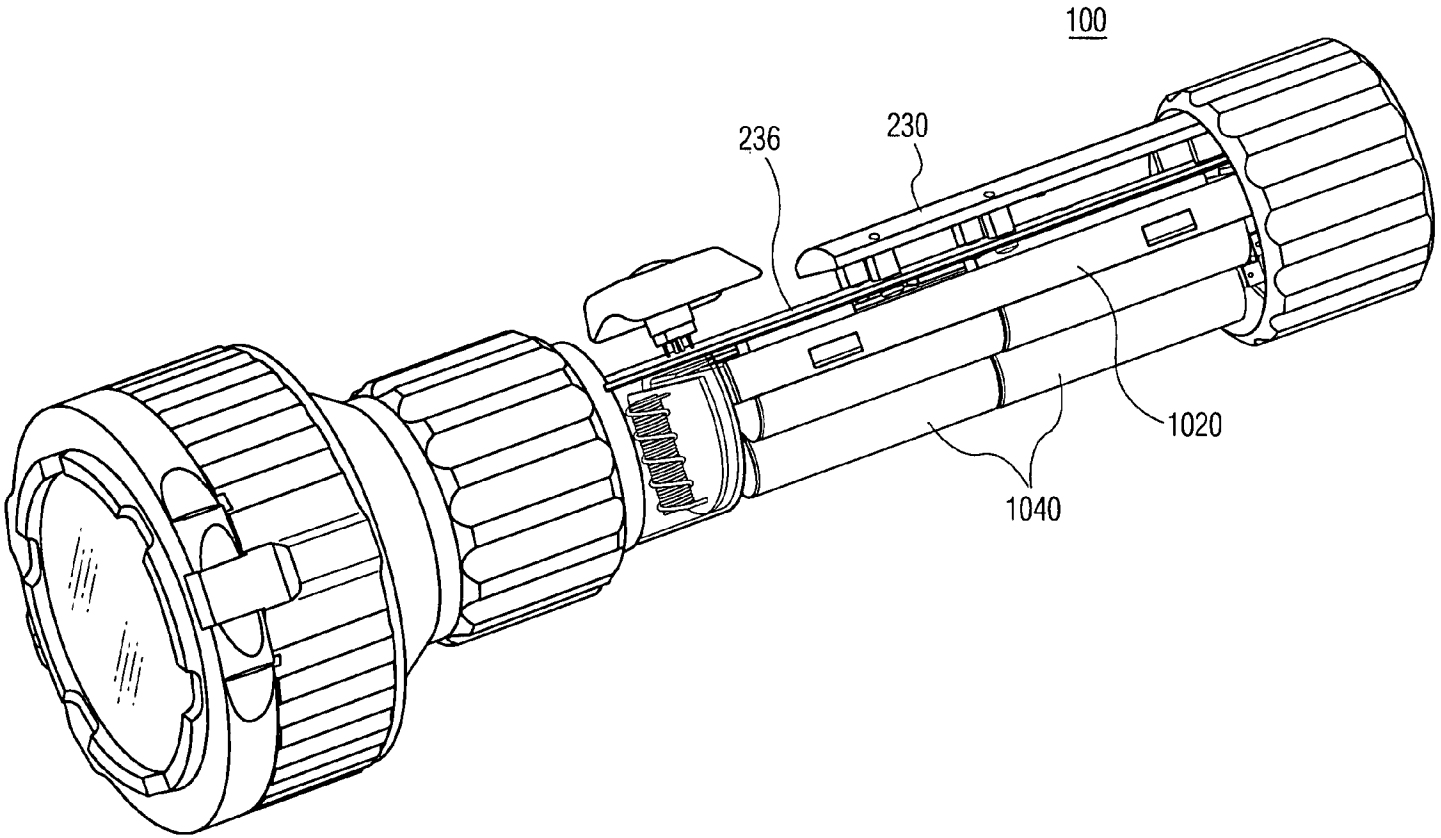
FIG. 10B illustrates the handheld searchlight of FIG. 10A with the bottom cover of the battery pack removed and illustrates a plurality of batteries.
Figure 10C:
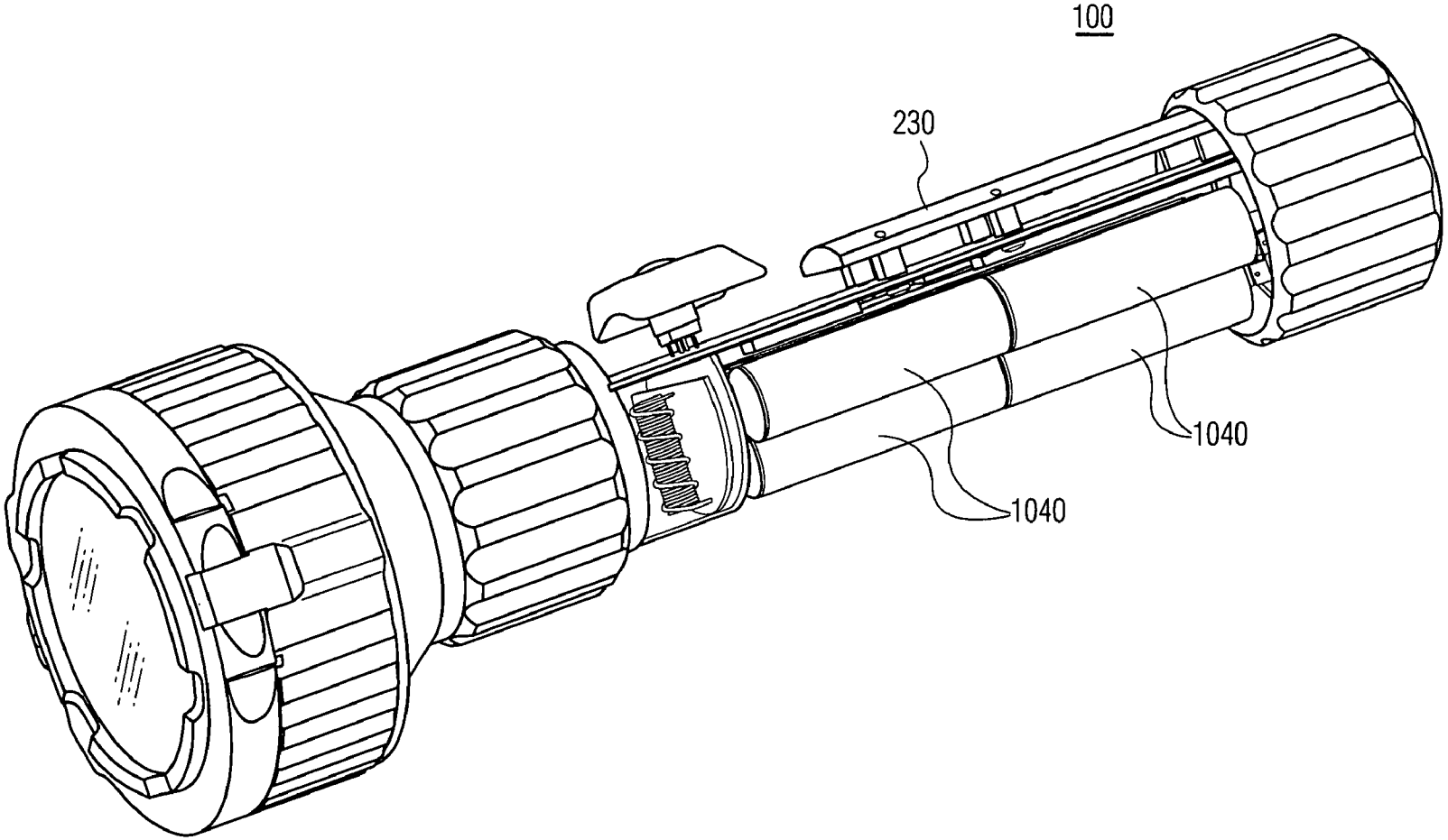

Referring now to FIG. 10A, handheld searchlight 100 of FIG. 1A is illustrated without housing 110. A printed circuit board 236 is visible and is in electrical communication with lamp assembly 228 (of FIG. 2) supported by bulk head 240. A heat-sink 230 is disposed on printed circuit board 236. A battery pack 232 is positioned along printed circuit board 236. Battery pack 232 includes a top cover 1020 and a bottom cover 1010. Batteries 1040 are visible in FIG. 10B wherein bottom cover 1010 is removed and in FIG. 10C as well, wherein both top cover 1020 and bottom cover 1040 are removed. Batteries 1040 may, for example, be a Lithium-ion cell or of other rechargeable or non-rechargeable type.

Figure 11A:
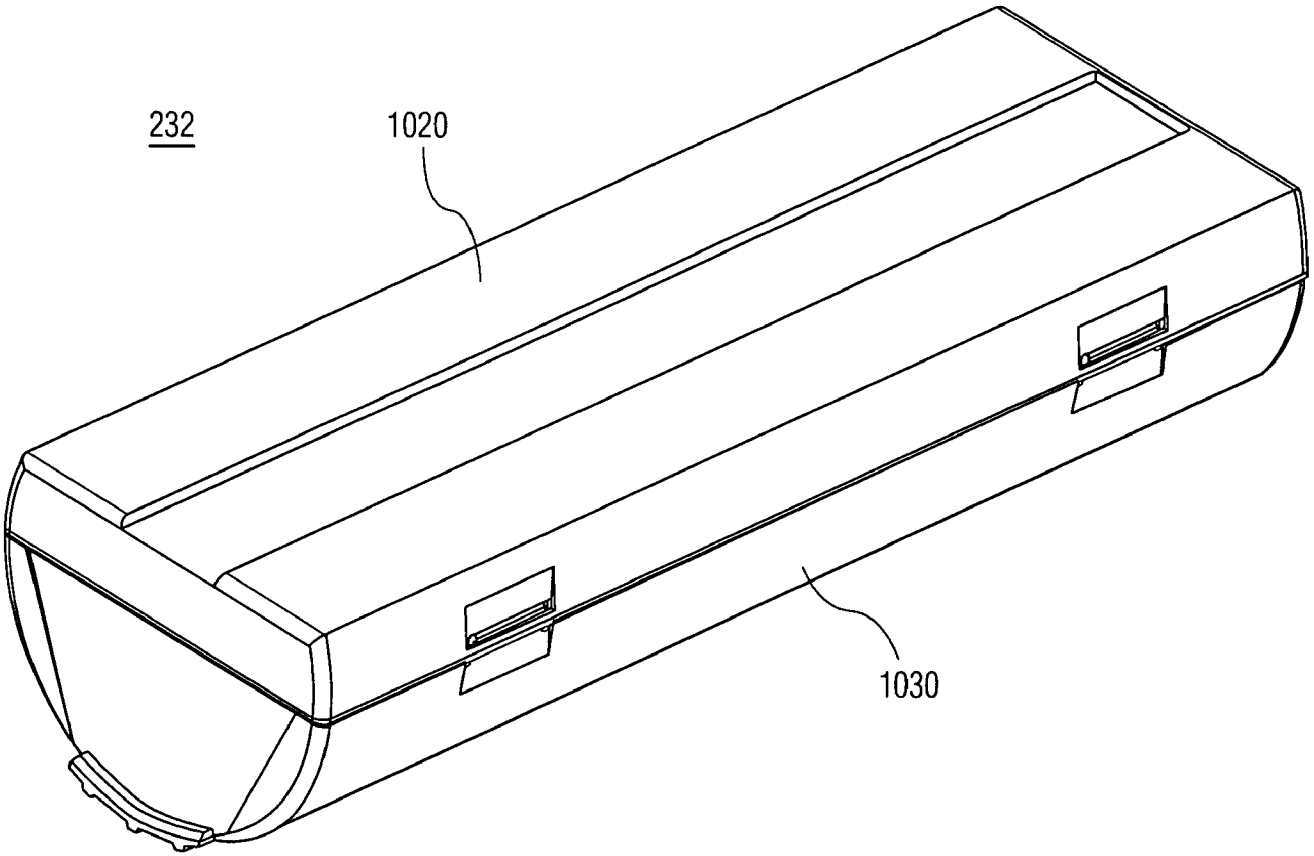
FIG. 11A illustrates an isometric view of an exemplary embodiment of the battery pack of FIG. 10A.
Figure 11B:
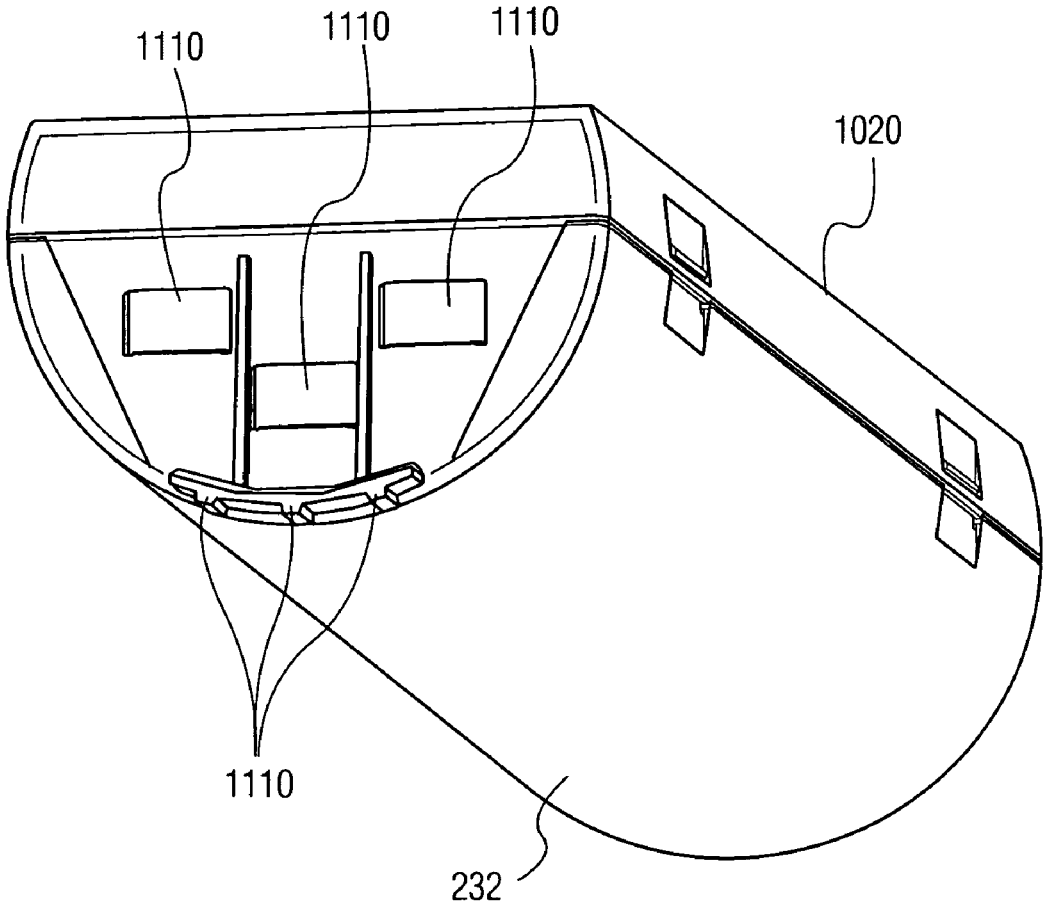
FIG. 11B illustrates another isometric view of the battery pack of FIG. 11A.

Referring now to FIGS. 11A-11B, an exemplary battery pack 232 is illustrated. Battery pack 232 includes contacts 1110 on one end. Contacts 1110 mate with contacts 560 (of FIG. 5C). Battery pack 232 may be made of plastic or other suitable material.

Such a handheld high intensity searchlight may not only used by military, and law enforcement but also entertainment and other professionals in various applications such as physical security, surveillance, crowd control, special effects and search and rescue operations.

Figure 12A:
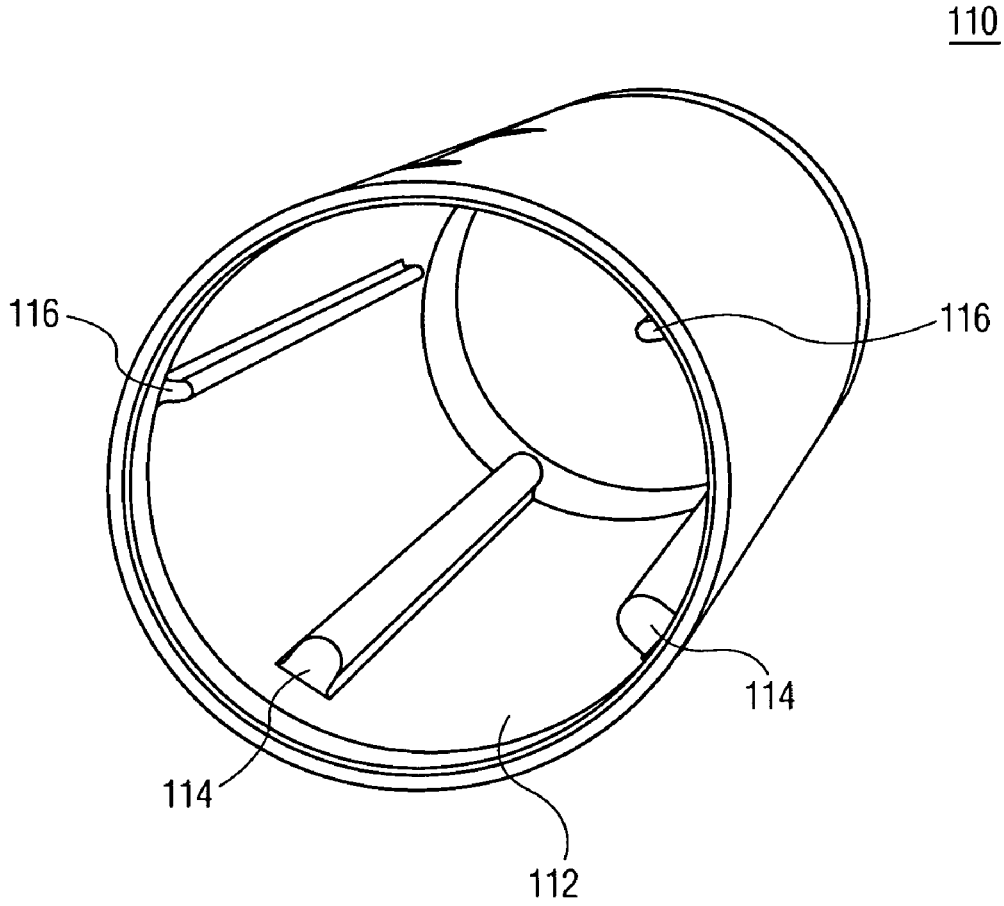
FIG. 12A illustrates an isometric view of the housing of FIG. 1A.
Figure 12B:
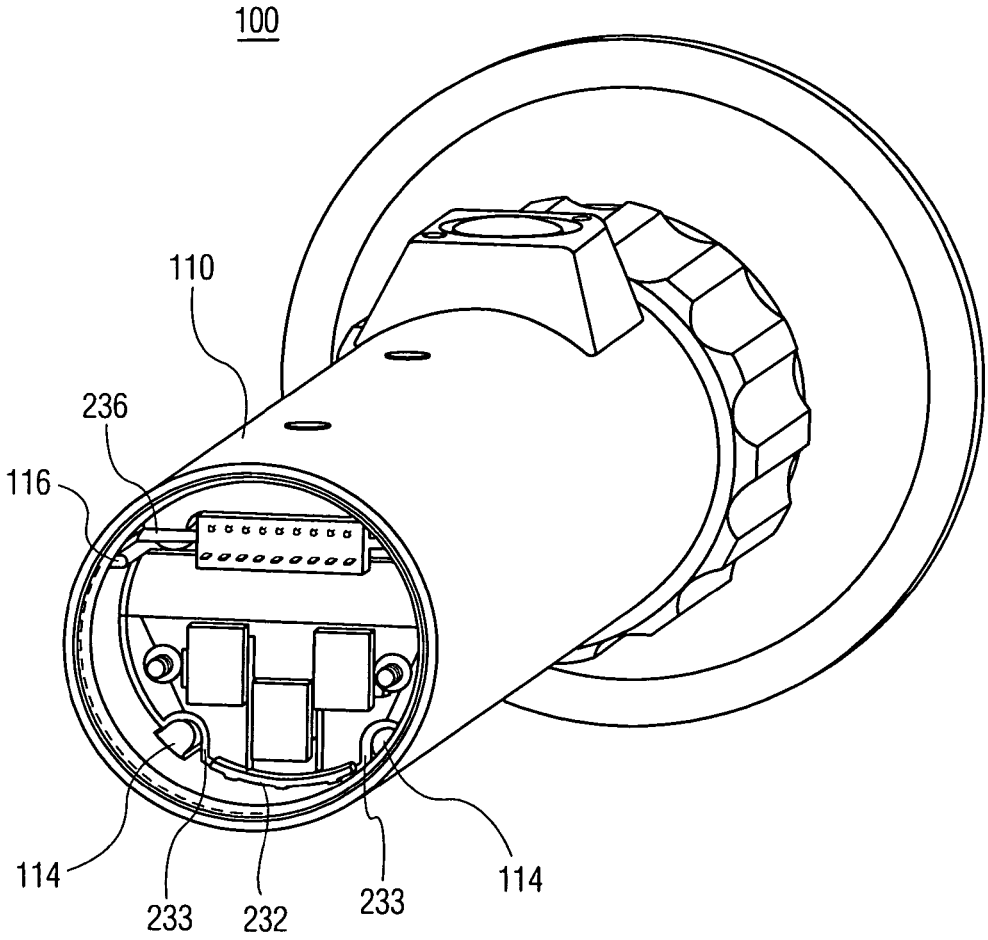
FIG. 12B illustrates an isometric end view of the handheld searchlight of FIG. 1 with the end cap assembly removed.
Figure 12C:
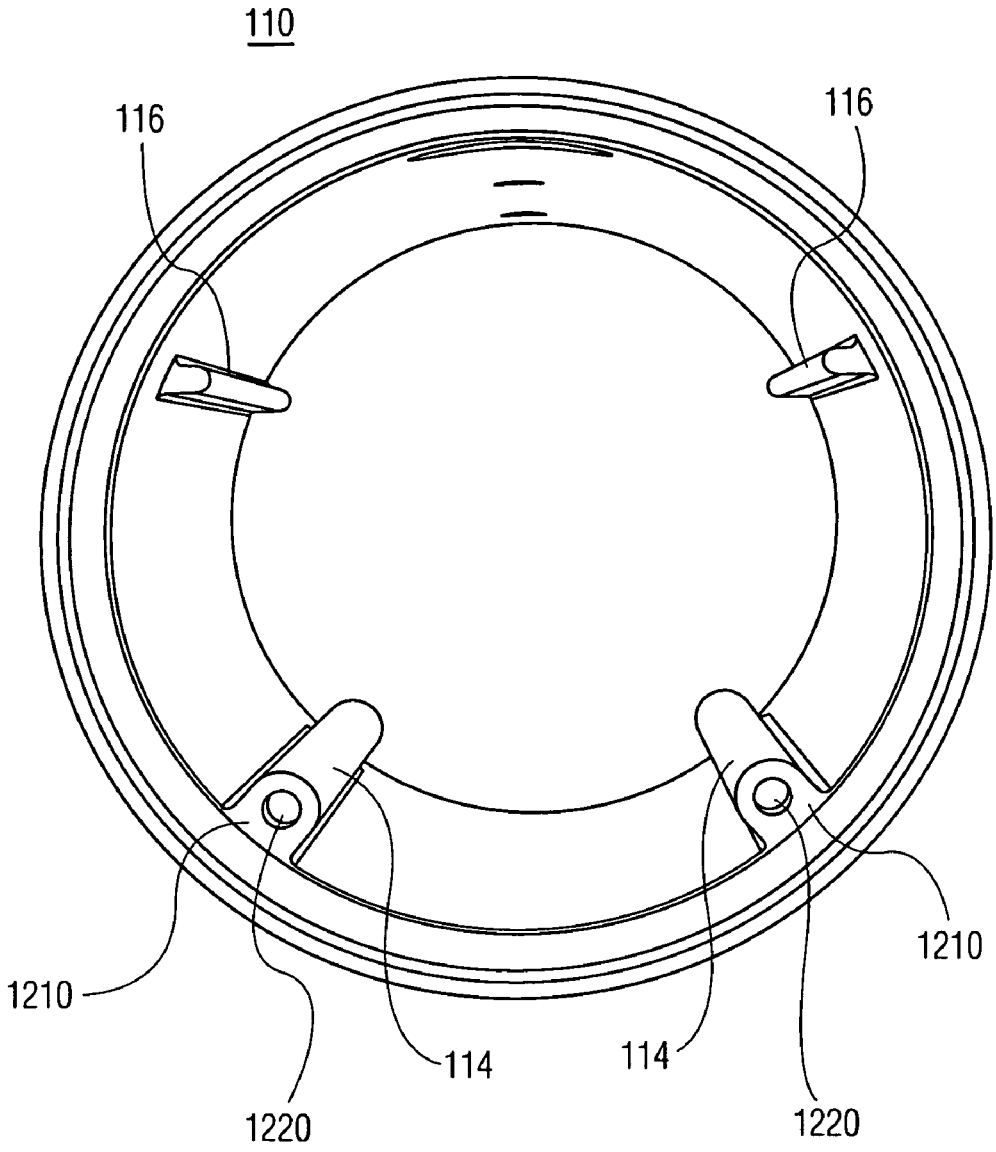
FIG. 12C illustrates an isometric end view of the housing of FIG. 12A.

Referring now to FIGS. 12A-12C, an embodiment of housing 110 is illustrated. Housing 110 has two sets of longitudinally extending guide rails 114, 116 protruding from its inner surface 112. As seen in FIG. 12B, guide rails 116 assist in supporting and mounting PCB 236 within housing 110. Similarly, guide rails 114 assist in guiding and mounting battery pack 232 inside housing 110. Battery pack 232 has corresponding longitudinal grooves 233 that receive guide rails 114. In the illustrated embodiment, there are two (2) guide rails 116 for PCB 236 and two guide rails 114 for battery pack 232. In other embodiments, guide rails 114, 116 may be more than or less than two (2) in number. In an exemplary embodiment, housing 110 with guide rails 114, 116 may be formed by extrusion. In an exemplary embodiment, guide rails 114 have planar ends 1210 (of FIG. 12C) that support bulkhead 240 (of FIG. 2). In the illustrated embodiment, guide rails 114 further define apertures 1220 (of FIG. 12C) that accommodate fasteners (not shown) that connect bulkhead 240 (of FIG. 2) to guide rails 114.

Although the present invention has been set forth in terms of the embodiments described herein, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the present invention be interpreted as encompassing all alterations, modifications, or alternative applications as fall within the true spirit and scope of the invention.

What is claimed is:

1. A handheld searchlight for producing a high intensity beam of light output, said searchlight comprising:

an elongated housing including a handle portion for gripping by a user;

a head having a window opening for transmitting a light beam;

a mechanical coupling between said housing and said head;

a parabolic reflector mounted in said head facing said window opening, said reflector defining an aperture for accommodating a high-intensity lamp, said reflector having a longitudinal optical axis, wherein rotation of said head about said coupling causes movement of said parabolic reflector relative to the lamp along said optical axis, thereby changing a spread of the high-intensity light beam;

a rotatable bezel ring comprising a non-threaded exterior surface and mounted on and rotatable relative to said head via a hinge member, responsive to a force applied on the exterior surface of said rotatable bezel ring;

a plurality of detents on a surface of said head;

a ball and spring plunger mounted in said rotatable bezel ring to releasably engage one of said plurality of detents, wherein said ball and spring plunger mechanically couples said rotatable bezel ring to said head;

a filter ring mount connected to said rotatable bezel ring; and an optical filter mounted in said filter ring mount.

2. The handheld searchlight of claim 1, wherein said filter ring mount is pivotably connected to said rotatable bezel ring via said hinge member, wherein said filter ring mount pivots about said hinge member between a first and a second position, wherein, in said first position, said optical filter is completely in the path of said high-intensity light beam and in said second position, said optical filter is completely outside the path of said high-intensity light beam.

3. The handheld searchlight of claim 2, wherein said hinge member comprises a spring tension pin.

4. The handheld searchlight of claim 1, wherein said mechanical coupling between said housing and said head comprises a threaded coupling.

5. The handheld searchlight of claim 4, wherein said head is adapted to be uncoupled from said elongated housing along threads of said threaded coupling, thereby providing access to said lamp.

6. The handheld searchlight of claim 1, wherein said optical filter is an infrared filter, said infrared filter being capable of transmitting only infrared light and absorbing visible light from said high-intensity lamp.

7. The handheld searchlight of claim 1, wherein said optical filter is an ultraviolet filter, said ultraviolet filter being capable of transmitting ultraviolet light and absorbing visible light from said high-intensity lamp.

8. The handheld searchlight of claim 1, further comprising:

a printed circuit board within said housing and having a first and a second surface opposite said first surface, and including circuitry to regulate and control power supplied to the lamp; and a heat sink mounted on a portion of said first surface of said circuit board, said heat sink being coupled to said housing at least rearward of the lamp to dissipate heat generated by said printed circuit board.

9. The handheld searchlight of claim 8, further comprising a battery pack, said battery pack including at least one battery, wherein said battery pack has a first end and a second end and one or more elongated sides, and wherein said battery pack has electrical contacts located alternatively on one of said first end or said second end or one of said elongated sides.

10. The handheld searchlight of claim 9, further comprising:

an end cap; and an electrical connector mounted on said end cap and having a first end and a second end, said electrical connector adapted at said first end to be connected to an external power source, and at said second end to be in electrical communication with said at least one battery and said printed circuit board.

11. The handheld searchlight of claim 1, wherein said elongated housing has a knurled surface to facilitate handling of the handheld searchlight by a user.

12. The handheld searchlight of claim 1, wherein the lamp is one of a mercury arc lamp, xenon arc lamp, metal halide arc lamp, and halogen arc lamp.

13. The handheld searchlight of claim 1, wherein said optical filter is field replaceable.

14. The handheld searchlight of claim 1, wherein said lamp is field replaceable.

15. The handheld searchlight of claim 1, wherein said rotatable bezel ring is rotatable relative to the head in an assembled state of said rotatable bezel ring on said searchlight.

16. The handheld searchlight of claim 1, wherein said head further comprises a flange extending radially outward from said head, and wherein said rotatable bezel ring is selectively engageable with said flange.

17. The handheld searchlight of claim 16, wherein said head further comprises a second bezel ring mounted thereon, and wherein the interior surface of said rotatable bezel ring faces the exterior surface of said second bezel ring.

18. The handheld searchlight of claim 17, wherein said rotatable bezel ring is rotatable relative to said second bezel ring.

19. A handheld searchlight comprising:

an elongated housing;

a printed circuit board housed in said housing;

a battery in electric communication with said printed circuit board, said battery housed in said housing;

a high-intensity lamp in electrical communication with said printed circuit board;

a head assembly rotatably and removably coupled to said housing, said head assembly comprising:

a head having a window for transmitting a light beam and rotatably and removably coupled to said housing;

a parabolic reflector mounted in said head, said parabolic reflector having an aperture adapted to accommodate said lamp, said reflector having a longitudinal optical axis, wherein rotation of said head about said housing causes movement of said parabolic reflector relative to the lamp along said optical axis, thereby changing a spread of the high-intensity beam;

a rotatable bezel ring mounted on said head and engaging said head along an interior surface of said rotatable bezel ring;

a plurality of detents on a surface of said head;

a ball and spring plunger mounted in said rotatable bezel ring to releasably engage one of said plurality of detents, wherein said ball and spring plunger mechanically couples said rotatable bezel ring to said head;

a filter ring mount pivotably mounted on said rotatable bezel ring via a hinge member; and an optical filter mounted in said filter ring mount.

20. The handheld searchlight of claim 19, further comprising:

an end cap assembly coupled to said elongated housing, said end cap assembly comprising:

an end cap; and an electrical connector mounted in said end cap, said electrical connector having a first end and a second end, said first end adapted to be in electric communication with an external power source, and second end adapted to be in electric communication with at least one of said printed circuit board and said battery.

21. The handheld searchlight of claim 19, further comprising:

a first magnet mounted in said rotatable bezel ring; and a second magnet mounted in said filter ring mount, wherein said first and second magnets lock said rotatable bezel ring with said filter ring mount.

22. The handheld searchlight of claim 19, further comprising an LED assembly, said LED assembly comprising:

a first LED adapted to indicate a charged status of said battery; and a second LED adapted to indicate a discharged or charging status of said battery.

* * * * *